US009348283B2

(12) United States Patent
Takada et al.

(10) Patent No.: US 9,348,283 B2
(45) **Date of Patent: *May 24, 2016**

(54) FIXING DEVICE HAVING ROTATABLE PRESSING MEMBER WITH NEEDLE-LIKE FILLER

(71) Applicant: CANON KABUSHIKI KAISHA, Tokyo (JP)

(72) Inventors: Shigeaki Takada, Abiko (JP); Toshinori Nakayama, Kashiwa (JP); Masayuki Tamaki, Abiko (JP); Naoki Akiyama, Toride (JP); Akeshi Asaka, Kashiwa (JP); Koichi Kakubari, Toride (JP); Yutaka Arai, Kawasaki (JP); Jun Miura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/798,613

(22) Filed: Jul. 14, 2015

(65) Prior Publication Data

US 2016/0018767 A1 Jan. 21, 2016

(30) Foreign Application Priority Data

Jul. 16, 2014 (JP) ..... 2014-145832

(51) Int. Cl.
*G03G 15/20* (2006.01)

(52) U.S. Cl.
CPC ..... *G03G 15/206* (2013.01); *G03G 15/2042* (2013.01); *G03G 2215/2035* (2013.01)

(58) Field of Classification Search
CPC ..... G03G 15/2053; G03G 15/2057; G03G 15/206
USPC ..... 399/333
See application file for complete search history.

(56) References Cited

U.S. PATENT DOCUMENTS 8,626,046 B2 * 1/2014 Sekihara ..... G03G 15/2057 219/216
8,755,726 B2 6/2014 Sugimoto
(Continued)

FOREIGN PATENT DOCUMENTS

JP 2012037613 A * 9/1991 ..... G03G 15/20
JP 2012-37613 A 2/2012

OTHER PUBLICATIONS

English translation of Description for JPA 2012-037613.*
(Continued)

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

A fixing device includes a rotatable heating member and a rotatable pressing member which are configured to fix a toner image on a recording material in a nip therebetween; and a heating mechanism configured to selectively heat regions of the rotatable heating member depending on sizes of the recording material when the sizes are predetermined ones of all sizes usable in the fixing device. The rotatable pressing member includes a base layer and a porous elastic layer provided on the base layer and containing a needle-like filler. The elastic layer having a thermal conductivity, with respect to a longitudinal direction thereof, which is 6 times to 900 times a thermal conductivity with respect to a thickness direction thereof.

10 Claims, 15 Drawing Sheets

(56) References Cited

U.S. PATENT DOCUMENTS

| | | | | |
|---|---|---|---|---|
| 9,063,491 | B2 | 6/2015 | Matsunaka et al. | |
| 9,086,664 | B2 | 7/2015 | Matsunaka et al. | |
| 9,152,110 | B2 * | 10/2015 | Miura | G03G 15/2057 |
| 2006/0188300 | A1 * | 8/2006 | Matsunaka | G03G 15/2053 399/333 |
| 2008/0219729 | A1 * | 9/2008 | Matsunaka | G03G 15/2053 399/330 |
| 2011/0237413 | A1 * | 9/2011 | Sakakibara | G03G 15/206 492/46 |
| 2012/0257913 | A1 * | 10/2012 | Sakakibara | G03G 15/206 399/331 |
| 2014/0116612 | A1 | 5/2014 | Akiyama et al. | |
| 2014/0255067 | A1 | 9/2014 | Matsunaka et al. | |
| 2014/0301763 | A1 | 10/2014 | Miura et al. | |
| 2015/0071690 | A1 * | 3/2015 | Miyahara | G03G 15/206 399/333 |
| 2015/0147101 | A1 * | 5/2015 | Nakayama | G03G 15/2057 399/329 |
| 2015/0160596 | A1 | 6/2015 | Asaka et al. | |
| 2016/0018766 | A1 * | 1/2016 | Akiyama | G03G 15/206 399/333 |

OTHER PUBLICATIONS

U.S. Appl. No. 14/755,075, filed Jun. 30, 2015, Tamura et al.
U.S. Appl. No. 14/741,750, filed Jun. 17, 2015, Asaka et al.
U.S. Appl. No. 14/755,098, filed Jun. 30, 2015, Akiyama et al.
U.S. Appl. No. 14/730,766, filed Jun. 4, 2015, Miura et al.

* cited by examiner (a)

(b)

FIXING DEVICE HAVING ROTATABLE PRESSING MEMBER WITH NEEDLE-LIKE FILLER

FIELD OF THE INVENTION AND RELATED ART

The present invention relates to a fixing device. This fixing device is usable in an image forming apparatus such as a copying machine, a printer, a facsimile machine and a multi-function machine having a plurality of functions of these machines.

A fixing device mounted in an image forming apparatus of an electrophotographic type includes a rotatable fixing member. Such as a fixing belt, and includes a rotatable pressing member such as a pressing roller.

In such a fixing device, in the case where a small-sized recording material is continuously subjected to fixing of a toner image thereon, there is a liability that a region where the fixing belt does not contact the recording material (hereinafter referred to as a non-passing region) excessively increases in temperature. Therefore, a constitution in which a region where the fixing belt is heated is limited depending on a size of the recording material to suppress excessive temperature rise in the non-passing region has been proposed (Japanese Laid-Open Patent Application 2012-37613).

However, there are various sizes of recording materials usable in the market, but there is a limitation on the number of species of the heating region of the fixing belt. That is, although the fixing device can meet the recording material (e.g., a regular-sized paper) having a size assumed to be frequently used, but it is difficult to meet the recording material (e.g., an irregular-sized paper) having a size which is not assumed to be frequently used by the user. In this case, there is a liability that the excessive temperature rise in the non-pressing region generates.

SUMMARY OF THE INVENTION

According to an aspect of the present invention, there is provided a fixing device comprising: a rotatable heating member and a rotatable pressing member which are configured to fix a toner image on a recording material in a nip therebetween; and a heating mechanism configured to selectively heat regions of the rotatable heating member depending on sizes of the recording material when the sizes are predetermined ones of all sizes usable in the fixing device, wherein the rotatable pressing member includes a base layer and a porous elastic layer provided on the base layer and containing a needle-like filler, the elastic layer having a thermal conductivity, with respect to a longitudinal direction thereof, which is 6 times to 900 times a thermal conductivity with respect to a thickness direction thereof.

These and other objects, features and advantages of the present invention will become more apparent upon a consideration of the following description of the preferred embodiments of the present invention taken in conjunction with the accompanying drawings.

DESCRIPTION OF EMBODIMENTS

Embodiment (1) Image Forming Portion

Figure 2:
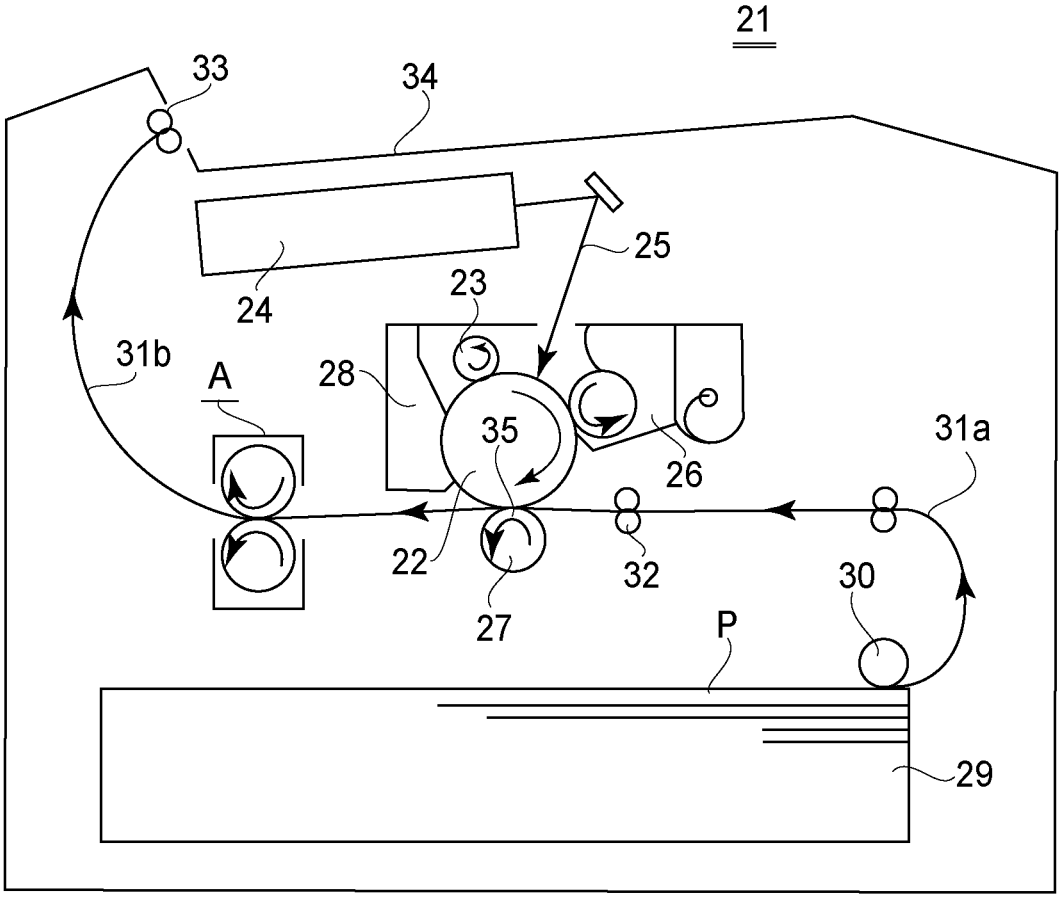
FIG. 2 is a schematic structural view of an example of an image forming apparatus.

FIG. 2 is a schematic sectional view showing a structure of an example of an image forming apparatus 21 in which an image heating apparatus in accordance with the present invention as a fixing device A.

This image forming apparatus 21 is a laser printer of an electrophotographic type and includes a photosensitive drum 22 as an image bearing member for bearing a latent image. The photosensitive drum 22 is rotationally driven in the clockwise direction of an arrow at a predetermined speed, and another surface thereof is electrically charged uniformly to a predetermined polarity and a predetermined potential by a charging device 23. The uniformly charged surface of the photosensitive drum 22 is subjected to laser scanning exposure to light 25 of image information by a laser scanner (optical device) 24. As a result, on the surface of the photosensitive drum 22, an electrostatic latent image of the image information obtained by the scanning exposure is formed.

The electrostatic latent image is developed into a toner image by a developing device 26. The toner image is successively transferred onto a sheet-like recording material (hereinafter referred to as a sheet or paper) P at a transfer portion 35, into which the sheet P is introduced, which is a contact portion between the photosensitive drum 22 and a transfer roller 27.

The sheets P are staked and accommodated in a sheet feeding cassette 29 provided at a lower portion of an inside of a main assembly of the image forming apparatus. When a sheet feeding roller 30 is driven at predetermined timing, one of the sheets P in the sheet feeding cassette 29 is separated and fed, and passes through a feeding path 31*a* to reach a registration roller pair 32. The registration roller pair 32 receives a leading end portion of the sheet P and corrects oblique movement thereof. Further, the sheet P is fed to the transfer portion 35 in synchronism with the toner image on the photosensitive drum 22 so as to provide timing when the leading end portion of the sheet P just reaches the transfer portion 35 when a leading end portion of the toner image on the photosensitive drum 22 reaches the transfer portion 35.

The sheet P passed through the transfer portion 35 is separated from the surface of the photosensitive drum 22 and then is fed to the fixing device A. By this fixing device A, an unfixed toner image on the sheet P is fixed as a fixed image on the sheet surface by heating and pressure application. Then, the sheet P passes through the feeding path 31*b* and then is discharged and stacked by a discharging roller pair 33 on a discharge tray 34 at an upper surface of the image forming apparatus main assembly. The surface of the photosensitive drum 22 after the separation of the sheet is cleaned by removing a residual deposited matter such as a transfer residual toner therefrom by a cleaning device 28, and then is repetitively subjected to image formation.

(2) Fixing Device A

The fixing device A will be described.

Figure 1:
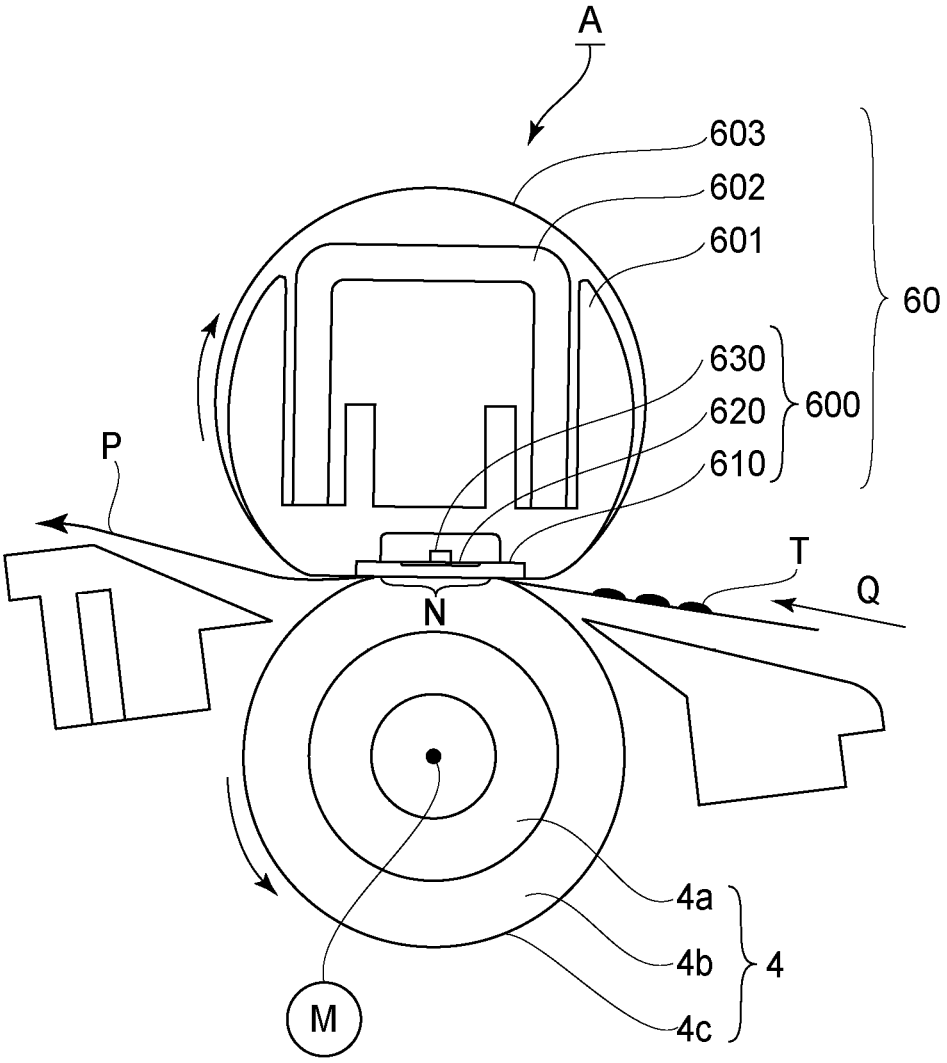
FIG. 1 is a schematic cross-sectional view showing a structure of a fixing device in an embodiment.

FIG. 1 is a view showing a schematic cross-sectional view showing a structure of the fixing device A in this embodiment.

Figure 3:
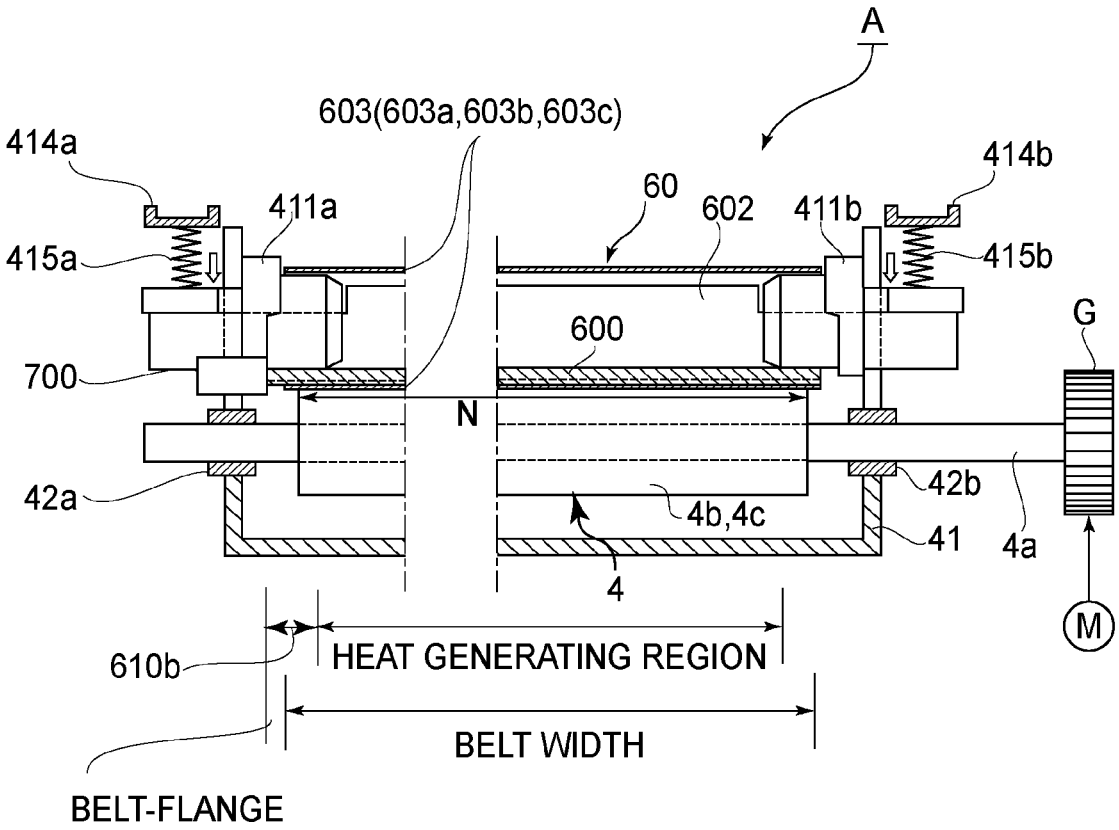
FIG. 3 is a schematic longitudinal front view of the fixing device.
Figure 4:
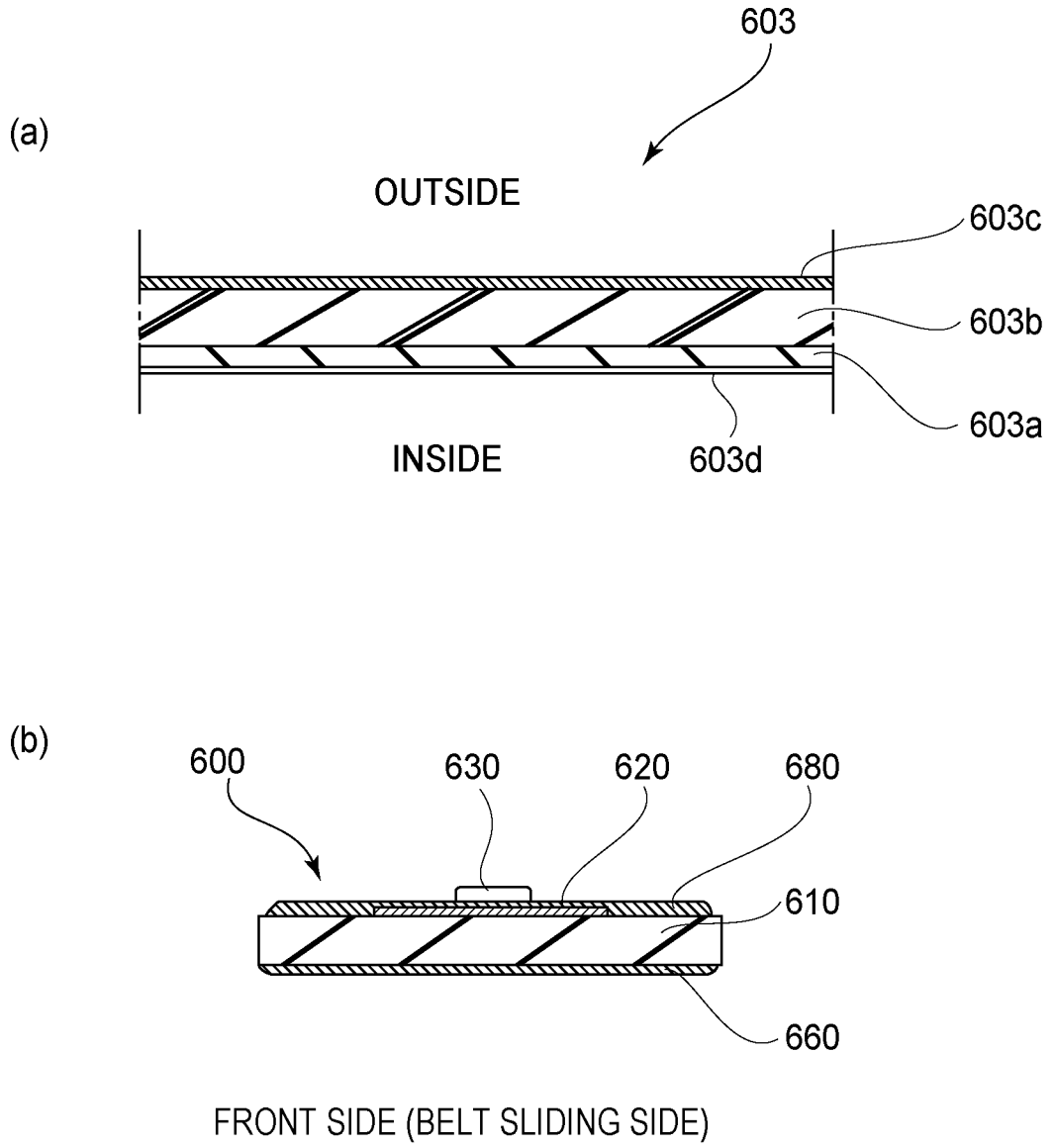
In FIG. 4, (a) is a schematic sectional view showing a layer structure of a fixing belt, and (b) is a schematic cross-sectional view of a heater.
Figure 5:
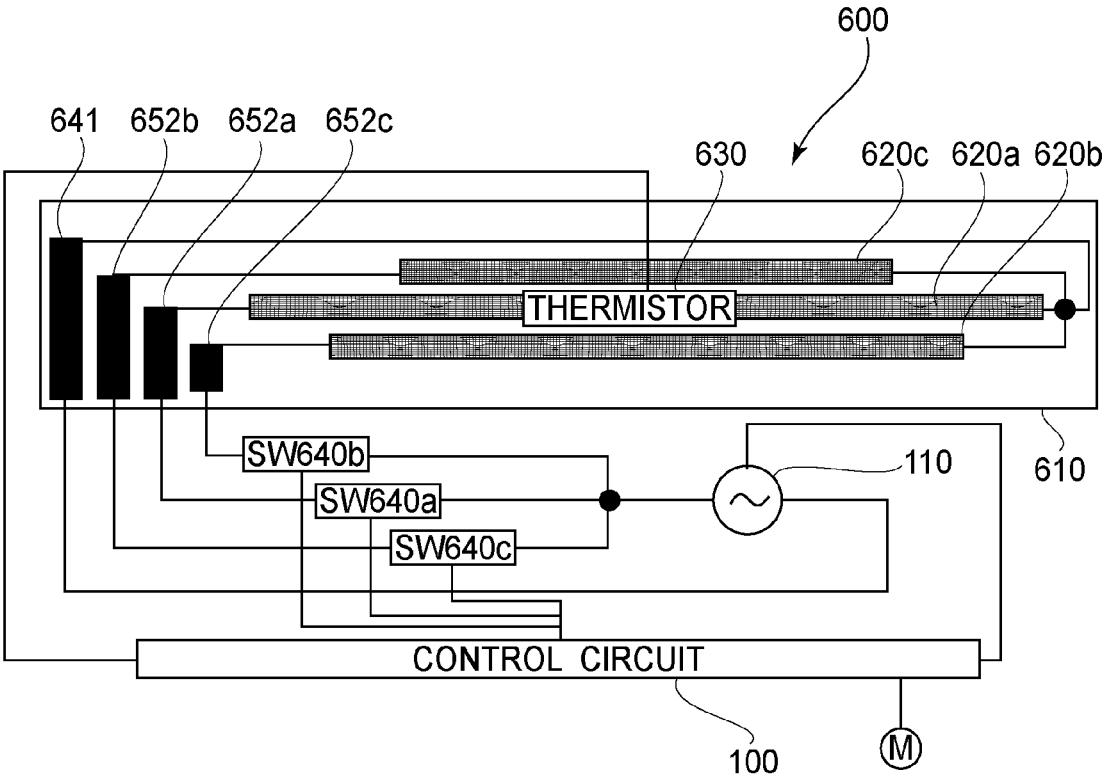
FIG. 5 is a schematic view showing heat generating elements, electroconductive patterns and an electric energy supplying system of the heater.

FIG. 3 is a schematic longitudinal front view of the fixing device. In FIG. 4, (a) is a schematic sectional view showing a layer structure of a fixing belt, and (b) is a schematic cross-sectional view of a heater. FIG. 5 is a schematic view showing heat generating elements, electroconductive patterns and an electric energy supplying system of the heater. Here, with respect to the fixing device A, a front surface is a surface in a side where the sheet P is introduced. Left and right are those when the fixing device A is seen from the front surface side.

The fixing device A is an image heating apparatus of a belt (film) heating type or a pressing roller driving type. The fixing device A includes a heater unit 60. The unit 60 is unit for heating and pressing the image on the sheet P, and includes a heater 600 as a heating mechanism, a heater holder 601, a supporting stay 602, and a belt 603 as a rotatable heating member.

The fixing device A further includes a pressing roller 4 as a rotatable pressing member, provided opposed to the unit 60, for forming a nip N. The unit 60 is provided so that a longitudinal direction thereof is in parallel to a longitudinal direction of the pressing roller 4. The sheet P on which an image T is carried is nipped and fed through the nip N to heat the image T. The pressing roller 4 is a nip forming member for forming the nip N in cooperation with the belt 603 in contact with an outer surface of the belt 603 of the unit 60.

The belt 603 is a flexible thin endless belt (fixing belt) 603 and is heated by the heater 600 as a heating member contacted to the inner surface of the belt 603 to heat the belt 603 (low thermal capacity structure). Therefore, the belt 603 can be efficiently heated, so that quick temperature rise at the start of the fixing operation is accomplished.

As described above, the belt 603 is nipped between the heater 600 and the pressing roller 4, by which the nip N is formed. The belt 603 rotates in the direction indicated by the arrow (clockwise in FIG. 1), and the roller 4 is rotated in the direction indicated by the arrow (counterclockwise in FIG. 1) to nip and feed the sheet P supplied to the nip N. At this time, the heat from the heater 600 is supplied to the sheet P through the belt 603, and therefore, the toner image T on the sheet P is heated and pressed by the nip N, so that the toner image it fixed on the sheet P by the heat and pressure. The sheet P having passed through the fixing nip N is separated from the belt 603 and is discharged. In this embodiment, the fixing process is carried out as described above.

The heater 600 is a heating member for heating the belt 603, slidably contacting with the inner surface of the belt 603. The heater 600 is pressed to the inside surface of the belt 603 toward the pressing roller 4 so as to provide a desired nip width of the nip N. The dimensions of the heater 600 in this embodiment are 5-20 mm in the width (the dimension as measured in the left-right direction in FIG. 1), 350-400 mm in the length (the dimension measured in the front-rear direction in FIG. 1), and 0.5-2 mm in the thickness. The heater 600 comprises a substrate 610 elongated in a direction perpendicular to a feeding direction Q of the sheet P (widthwise direction of the sheet P), and a heat generating resistor 620 (heat generating element 620).

The heater 600 is fixed on the lower surface of the heater holder 601 along the longitudinal direction of the heater holder 601. In this embodiment, the heat generating element 620 is provided on the back side of the substrate 610 which is not in slidable contact with the belt 603, but the heat generating element 620 may be provided on the front surface of the substrate 610 which is in slidable contact with the belt 603. However, the heat generating element 620 is preferably provided on the back side of the substrate 610, by which uniform heating effect to the substrate 610 is accomplished, from the standpoint of preventing non-uniform heat application which may be caused by a non-heat generating portion of the heat generating element 620. The details of the heater 600 will be described hereinafter.

The belt 603 is a flexible cylindrical (endless) belt (film) for heating the image on the sheet in the nip N. The belt 603 comprises a base material 603*a*, an elastic layer 603*b* thereon, and a parting layer 603*c* on the elastic layer 603*b*, for example, as schematically shown in (a) of FIG. 4 showing a layer structure.

The base material 603*a* may be made of metal material such as stainless steel or nickel, or a heat resistive resin material such as polyimide. The elastic layer 603*b* may be made of an elastic and heat resistive material such as a silicone rubber or a fluorine-containing rubber. The parting layer 603*c* may be made of fluorinated resin material or silicone resin material The belt 603 of this embodiment as dimensions of approx. 30 mm in the outer diameter, approx. 330 mm in the length (the dimension measured in the front-rear direction in FIG. 1), approx. 30 μm in the thickness, and the material of the base material 603*a* is nickel. The silicone rubber elastic layer 603*b* having a thickness of approx. 400 μm is formed on the base material 603*a*, and a fluorine resin tube (parting layer 603*c*) having a thickness of approx. 20 μm coats the elastic layer 603*b*.

In the heater 600, on the surface of the substrate 610 in a side contacting the inner surface of the belt 603, a polyimide layer 660 having a thickness of approx. 10 μm may be provided as a sliding layer as shown in (b) of FIG. 4. When the polyimide layer 660 is provided, the rubbing (sliding) resistance between the belt 603 and the heater 600 is low, and therefore, the wearing of the inner surface of the belt 603 can be suppressed. In order to further enhance the slidability, a lubricant such as grease may be applied to the inner surface of the belt. The inner surface of the belt 603 may be provided with the sliding layer.

The heater holder 601 (holder 601) functions to hold the heater 600 in the state of urging the heater 600 toward the inner surface of the belt 603. The holder 601 has a semi-arcuate cross-section (the surface of FIG. 1) and functions to regulate a rotation orbit of the belt 603. The holder 601 may be made of heat resistive resin material or the like. In this embodiment, it is Zenite 7755 (tradename) available from Dupont.

The support stay 602 supports the heater 600 by way of the holder 601. The support stay 602 is preferably be made of a material which is not easily deformed even when a high pressure is applied thereto, and in this embodiment, it is made of SUS304 (stainless steel).

As shown in FIG. 3, the support stay 602 is supported by left and right flanges 411*a* and 411*b* at the opposite end portions with respect to the longitudinal direction. The flanges 411*a* and 411*b* may be simply called flange 411. The flange 411 regulates the movement of the belt 603 in the longitudinal direction and the circumferential direction configuration of the belt 603. The flange 411 is made of heat resistive resin material or the like. In this embodiment, it is PPS (polyphenylenesulfide resin material).

Between the flange 411*a* and a pressing arm 414*a*, an urging spring 415*a* is compressed. Also, between a flange 411*b* and a pressing arm 414*b*, an urging spring 415*b* is compressed. The urging springs 415*a* and 415*b* may be simply called urging spring 415.

With such a structure, an elastic force of the urging spring 415 is applied to the heater 600 through the flange 411 and the support stay 602. The belt 603 is pressed against the upper surface of the pressing roller 4 at a predetermined urging force to form the nip N having a predetermined nip width with respect to the sheet feeding direction. In this embodiment, the pressure is approx. 156.8 N at one end portion side and approx. 313.6 N (32 kgf) in total.

A connector 700 is provided as an electric energy supplying member electrically connected with the heater 600 to supply the electric power to the heater 600. The connector 700 is detachably provided at one longitudinal end portion of the heater 600. The connector 700 is easily detachably mounted to the heater 600, and therefore, assembling of the fixing device A and the exchange of the heater 600 or belt 603 upon damage of the heater 600 is easy, thus providing good maintenance property. Details of the connector 700 will be described hereinafter.

A thermistor 630 is a temperature sensor provided on a back side of the heater 600 (opposite side from the sliding surface side. The thermistor 630 is bonded to the heater 600 in the state that it is insulated from the heat generating element 620. The thermistor 630 has a function of detecting a temperature of the heater 600. As shown in FIG. 5, the thermistor 630 is connected with a control circuit 100 (controller, control means) through an A/D converter (unshown) and feed an output corresponding to the detected temperature to the control circuit 100.

The control circuit 100 comprises a circuit including a CPU operating for various controls, a non-volatilization medium such as a ROM storing various programs. The programs are stored in the ROM, and the CPU reads and execute them to effect the various controls. The control circuit 100 may be an integrated circuit such as ASIC if it is capable of performing the similar operation.

The control circuit 100 is electrically connected with the voltage source 110 so as to control electric power supply from the voltage source 110. The control circuit 100 is electrically connected with the thermistor 630 to receive the output of the thermistor 630.

The control circuit 100 uses the temperature information acquired from the thermistor 630 for the electric power supply control for the voltage source 110. More particularly, the control circuit 100 controls the electric power to the heater 600 through the voltage source 110 on the basis of the output of the thermistor 630. In this embodiment, the control circuit 100 carries out a wave number control of the output of the voltage source 110 to adjust an amount of heat generation of the heater 600. By such a control, the heater 600 is maintained at a predetermined temperature (approx. 180° C., for example).

As shown in FIG. 3, a base material (core metal) 4*a* of the pressing roller 4 is rotatably held by bearings 42*a* and 42*b* provided in a rear side (left side) and a front side (right side) of the side plate 41, respectively, of a device frame. One axial end (right side) of the base material 4*a* is provided with a gear G to transmit the driving force from a motor M to the base material 4*a* of the pressing roller 4.

As shown in FIG. 1, the pressing roller 4 receiving the driving force from the motor M rotates in the direction indicated by the arrow (clockwise direction). In the nip N, the driving force is transmitted to the belt 603 by the way of the pressing roller 4, so that the belt 603 is rotated in the direction indicated by the arrow (counterclockwise direction).

The motor M is a driving means for driving the pressing roller 4 through the gear G. As shown in FIG. 5, the control circuit 100 is electrically connected with the motor M to control the electric power supply to the motor M. When the electric energy is supplied by the control of the control circuit 100, the motor M starts to rotate the gear G.

The control circuit 100 controls the rotation of the motor M. The control circuit 100 rotates the pressing roller 4 and the belt 603 using the motor M at a predetermined speed. It controls the motor so that the speed of the sheet P nipped and fed by the nip N in the fixing process operation is the same as a predetermined process speed (approx. 200 [mm/sec], for example).

[Heater]

The heater 600 will be described principally with reference to (a) of FIG. 4 and FIGS. 5-8.

The heater 600 as the heating mechanism comprises the substrate 610, heat generating elements 620 (620*a*-620*c*) on the substrate 610, electroconductor patterns (electroconductive lines), and an insulation coating layer 680 covering the heat generating elements 620 (620*a*-620*c*) and the electroconductor pattern.

The substrate 610 determines the dimensions and the configuration of the heater 600 and is contactable to the belt 603 along the longitudinal direction of the substrate 610. The material of the substrate 610 is a ceramic material such as alumina, aluminum nitride or the like, which has high heat resistivity, thermo-conductivity, electrical insulative property or the like. In this embodiment, the substrate is a plate member of alumina having a length (measured in the left-right direction in FIG. 5) of approx. 400 mm, a width (up-down direction in FIG. 5) of approx. 10 mm and a thickness of approx. 1 mm.

On the back side of the substrate 610, the heat generating elements 620 (620*a*-620*c*) and the electroconductor patterns (electroconductive lines) are provided through thick film printing method (screen printing method) using an electroconductive thick film paste. In this embodiment, a silver paste is used for the electroconductor pattern so that the resistivity is low, and a silver-palladium alloy paste is used for the heat generating elements 620 (620*a*-620*c*) so that the resistivity is high.

The heat generating elements 620 (620*a*-620*c*) and the electroconductor patterns are coated with the insulation coating layer 680 of heat resistive glass so that they are electrically protected from leakage and short circuit.

The heat generating elements 620 (620*a*-620*c*) are a resistor capable of generating joule heat by electric power supply (energization). The heat generating elements 620 (620*a*-620*c*) are formed as heat generating element members extending in the longitudinal direction on the substrate 610. The heat generating elements 620 (620*a*-620*c*) have a desired resistance value, and have a width (measured in the widthwise direction of the substrate 610) of 1-4 mm, a thickness of 5-20 μm.

The heat generating elements 620 (620*a*-620*c*) in this embodiment have the width of approx. 1 mm and the thickness of approx. 10 μm. In this embodiment, the heat generating element 620*a* has a longitudinal length of 300 mm, the heat generating element 620*b* has a longitudinal length of 260 mm, and the heat generating element 620*c* has a longitudinal length of 222 mm.

The connector 700 is connected with the heater 700, and then a voltage is applied to common electrode 641 and opposite electrodes 652 (652*a*-652*c*), by which a current flows through the heat generating elements 620 (620*a*-620*c*), and thus each of the heat generating elements 620 (620*a*-620*c*) generates heat.

[Connector]

Figure 6:
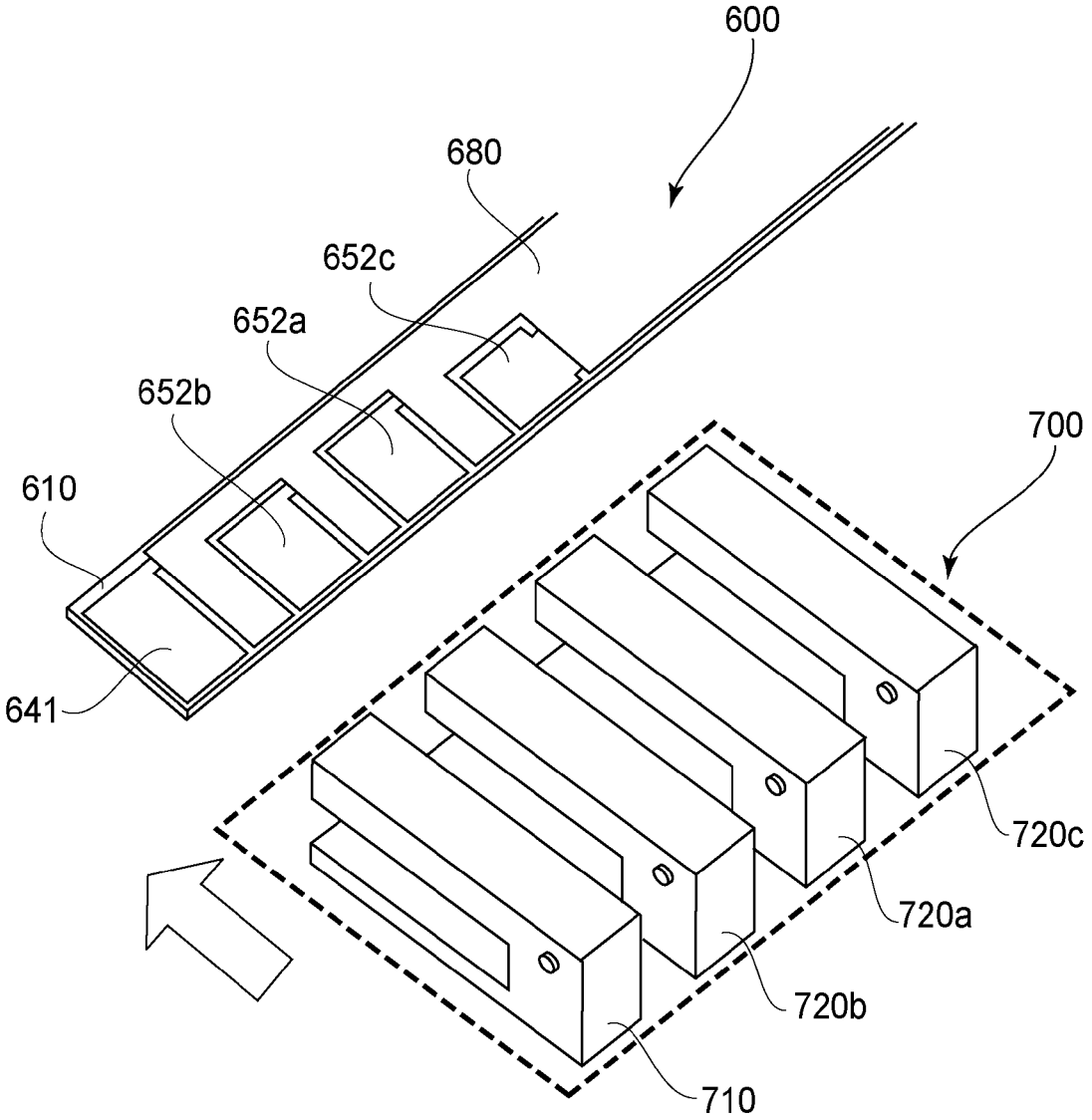
FIG. 6 illustrates a connector.
Figure 7:
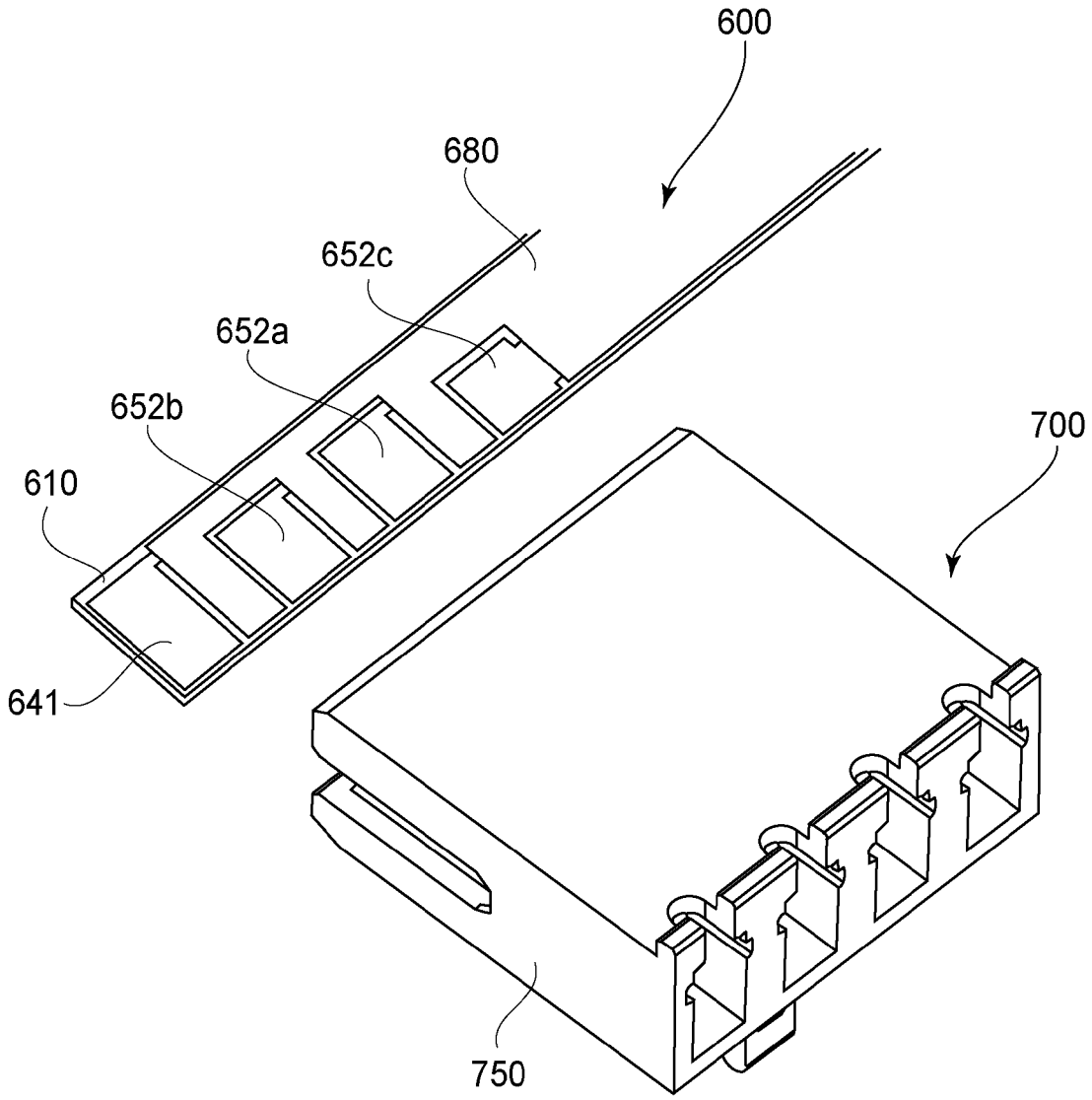
FIG. 7 illustrates a housing of the connector.
Figure 8:
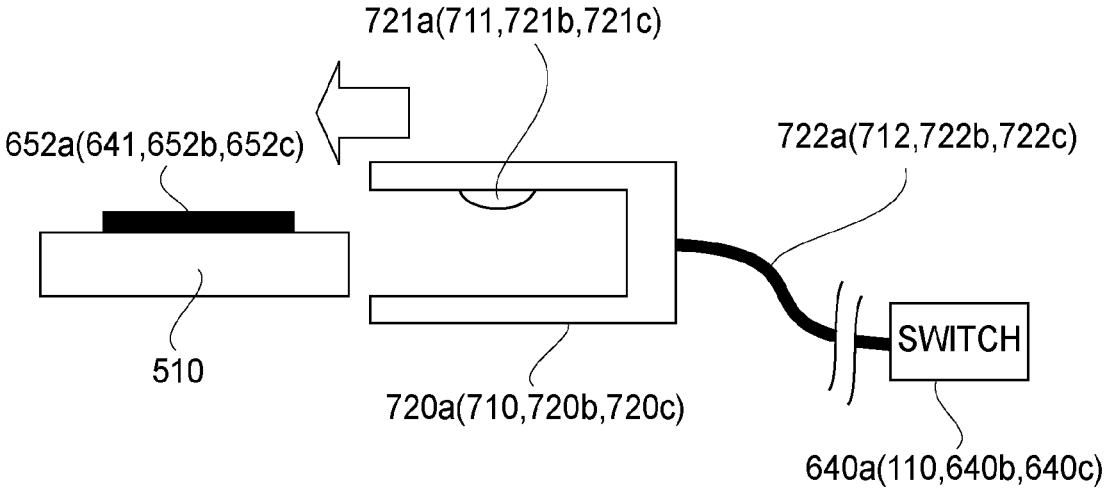
FIG. 8 illustrates a contact terminal.

The structure of the connector 700 will be described in detail. FIG. 6 is an illustration of the connector 700. FIG. 7 is an illustration of a housing 750. FIG. 8 is an illustration of a contact terminal 710.

The connector 700 of this embodiment is electrically connected with the heater 600 by mounting to the heater 600. The connector 700 comprises the contact terminal 710 electrically connectable with the common electrode 641, and contact terminals 720 (720*a*-720*c*) electrically connectable with the opposite electrodes 652 (652*a*-652*c*). The connector 700 sandwiches a region of the heater 600 extending out of the belt 603 so as not to contact with the belt 603, by which the contact terminals are electrically connected with the electrical contacts, respectively connected with the electrical contacts, respectively.

In the fixing device A of this embodiment having the above-described structures, no soldering or the like is used for the electrical connection between the connectors and the electrical contacts. Therefore, the electrical connection between the heater 600 and the connector 700 which rise in temperature during the fixing process operation can be accomplished and maintained with high reliability. In the fixing device A of this embodiment, the connector 700 is detachably mountable relative to the heater 600, and therefore, the belt 603 and/r the heater 600 can be replaced without difficulty.

As shown in FIG. 6, the connector 700 provided with the metal contact terminals 710, 720*a*, 720*b*, 720*c* is mounted to the heater 600 in the widthwise direction of the substrate 610 at one end portion side of the substrate. The contact terminals 710, 720*a*, 720*b*, 720*c* will be described, taking the contact terminal 720*a* for instance.

As shown in FIG. 8, the contact terminal 720*a* functions to electrically connect the opposite electrode 652*a* to a switch SW640*a* which will be described hereinafter. The contact terminal 720*a* is provided with a cable 722*a* for the electrical connection between the switch SW640*a* and the electrical contact 721*a* for contacting to the opposite electrode 652*a*. The contact terminal 720*a* has a channel-like configuration, and by moving in the direction indicated by an arrow in FIG. 8, it can receive the heater 600.

The portion of the contact terminal 720*a* which contacts the opposite electrode 652*a* is provided with the electrical contact 721*a* which contacts the opposite electrode 652*a*, by which the electrical connection is established between the opposite electrode 652*a* and the contact terminal 720*a*. The electrical contact 720*a* has a leaf spring property, and therefore, contacts the opposite electrode 652*a* while pressing against it. Therefore, the contact terminal 720*a* sandwiches the heater 600 between the front and back sides to fix the position of the heater 600.

Similarly, the contact terminal 710 functions to electrically connect the common electrode 641 which a power source 110. The contact terminal 710 is provided with a cable 712 (FIG. 8) for the electrical connection between the power source 110 and the electrical contact 711 (FIG. 8) for contacting to the common electrode 641.

Similarly, the contact terminal 720*b* functions to electrically connect the opposite electrode 652*b* with the switch SW640*b* which will be described hereinafter. The contact terminal 720*b* is provided with a cable 722*b* (FIG. 8) for the electrical connection between the switch SW640*b* and the electrical contact 721*b* (FIG. 8) for contacting to the opposite electrode 652*b*.

Similarly, the contact terminal 720*c* functions to electrically connect the opposite electrode 652*c* with the switch SW640*c* which will be described hereinafter. The contact terminal 720*c* is provided with a cable 722*b* (FIG. 8) for the electrical connection between the switch SW640*c* and the electrical contact 721*c* (FIG. 8) for contacting to the opposite electrode 652*c*.

As shown in FIG. 7, the contact terminals 710, 720*a*, 720*b*, 720*c* of metal are integrally supported on the housing 750 of resin material. The contact terminals 710, 720*a*, 720*c*, 720*c* are provided in the housing 750 with spaces between adjacent ones so as to be connectable with the electrical contacts 641, 652*a*, 652*b*, 652*c*, respectively when the connector 700 is mounted to the heater 600. Between adjacent contact terminals, partitions are provided to electrically insulate between the adjacent contact terminals.

In this embodiment, the connector 700 is mounted in the widthwise direction of the substrate 610, but this mounting method is not limiting to the present invention. For example, the structure may be such that the connector 700 is mounted in the longitudinal direction of the substrate.

[Electric Energy Supply to Heater]

An electric energy supply method to the heater 600 will be described. The fixing device A of this embodiment is capable of changing a width size of the heat generating region of the heater 600 by controlling the electric energy supply to the heater 600 in accordance with the width size of the sheet P. That is, the heater 600 is capable of changing the heat generating region into a plurality of sections with respect to the longitudinal direction, and the control circuit (functions as a part of the heating mechanism) 100 controls the heat generating region of the heater 600 depending on the width size of the sheet introduced into the fixing device A.

With such a structure, the heat can be efficiently supplied to the sheet P. In the fixing device A of this embodiment, the sheet P is fed with the center of the sheet P aligned with the center of the fixing device A, and therefore, the heat generating region extend from the center portion. The electric energy supply to the heater 600 will be described using FIG. 5.

The power source (voltage source) 110 is a circuit for supplying the electric power to the heater 600. In this embodiment, the commercial voltage source (AC voltage source) of approx. 100 V in effective value (single phase AC) is used. The voltage source 110 may be DC voltage source if it has a function of supplying the electric power to the heater 600.

As shown in FIG. 5, the control circuit 100 is electrically connected with the switch SW640*a*, the switch SW640*b*, and the switch SW640*c*, respectively to control the switch SW640*a*, the switch SW640*b*, and the switch SW640*c*, respectively.

The switches SW640 (640*a*-640*c*) are switches (relays) provided between the voltage source 110 and the opposite electrodes 652 (652*a*-652*c*). The switches SW640 (640*a*-640*c*) connects or disconnects between the voltage source 110 and the opposite electrodes 652 (652*a*-652*c*) in accordance with the instructions from the control circuit 100.

When the control circuit 100 receives the execution instructions of a job, the control circuit 100 acquires the width size information of the sheet P to be subjected to the fixing process. In accordance with the width size information of the sheet P, a combination of ON/OFF of the switches SW640 (640*a*-640*c*) is controlled so that the heat generation width of the heat generating element 620 fits the sheet P.

At this time, the control circuit 100, the voltage source 110, the switches 640 (640*a*-640*c*), and the connector 700 function as an electric energy supplying means for supplying the electric energy (power) to the heater 600.

When the sheet P is a large size sheet (an usable maximum width size), that is, when A3 size sheet is fed in the longitudinal direction or when the A4 size is fed in the landscape fashion, the width of the sheet P is approx. 297 mm. Therefore, the control circuit 100 effects control so that the heat generating element 620*a* generates heat. Accordingly, the control circuit 100 renders ON the switch SW643*a* and renders OFF the switches SW643*b*, SW643*c*. As a result, the electrode 652*a* of the heater 600 is supplied with the electric power, so that the heat generating element 620*a* generates heat. At this time, the heater 600 generates the heat uniformly over the approx. 300 mm region to meet the approx. 297 mm sheet P.

When the size of the sheet P is a small size (narrower than the maximum width), that is, when an A4 size sheet is fed longitudinally, or when an A5 size sheet is fed in the landscape fashion, the width of the sheet P is approx. 210 mm. Therefore, the control circuit 100 renders ON the switch SW643*c* and renders OFF the switches SW643*a* and SW643*b*. As a result, the electrode 652*c* of the heater 600 is supplied with the electric power, so that the heat generating element 620*c* generates heat. At this time, the heater 600 generates the heat uniformly over the approx. 222 mm region to meet the approx. 210 mm sheet P.

The user uses various species of sizes of the paper. Example of principal paper sizes include A3 size (420 mm×297 mm), A4 size (297 mm×210 mm), A5 size (210 mm×148 mm), B4 size (364 mm×257 mm) and B5 size (257 mm×182 mm).

Further, leisure size (432 mm×279 mm), letter size (279 mm×216 mm), executive size (267 mm×184 mm) and the like are frequently used overseas. Further, with respect to an envelope, there are various species of sizes. Further, the A4-sized paper, the B5-sized paper and the like are fed longitudinally in some cases.

Accordingly, the user uses a variety of width sizes of the sheets P. However, in this embodiment, the three heat generating elements are used, and therefore the paper width and the heat generating region cannot be made equal to each other with respect to each of all the paper sizes.

For example, in the case here the sheet P having the executive size is fed in the landscape fashion, the width size of the sheet P is 267 mm. The heat generating element 620*b* is 260 mm in length, and therefore end portions of the sheet P are not heated, and therefore control for heating the heat generating element 620*a* is effected. Accordingly, the control circuit 100 turns on the switch SW643*a* and turns off the switches SW643*b*, SW643*c*. As a result, the electrode 652*a* of the heater 600 is supplied with the electric energy, so that the heat generating element 620*a* generates heat.

At this time, the heater 600 generates heat uniformly over approx. 300 mm region, and the width size of the sheet P is 267 mm, so that a difference of 33 mm generates between the heat generating region and the width size of the sheet P. The fixing device A in this embodiment feeds the sheet P on a center(-line) basis, and therefore a region, where the sheet P does not pass, of 16.5 mm generates at each of end portions of the heat generating region. A gap (difference) between the heat generation region and the width size of the sheet P is referred to as a non-sheet-passing portion width.

That is, the number of species of the width sizes of the sheets P usable in the fixing device is larger than the number of possible changes in heat generating region of the heater 600. Further, the heater 600 is capable of meeting width sizes of irregular-sized sheets.

Figure 9:
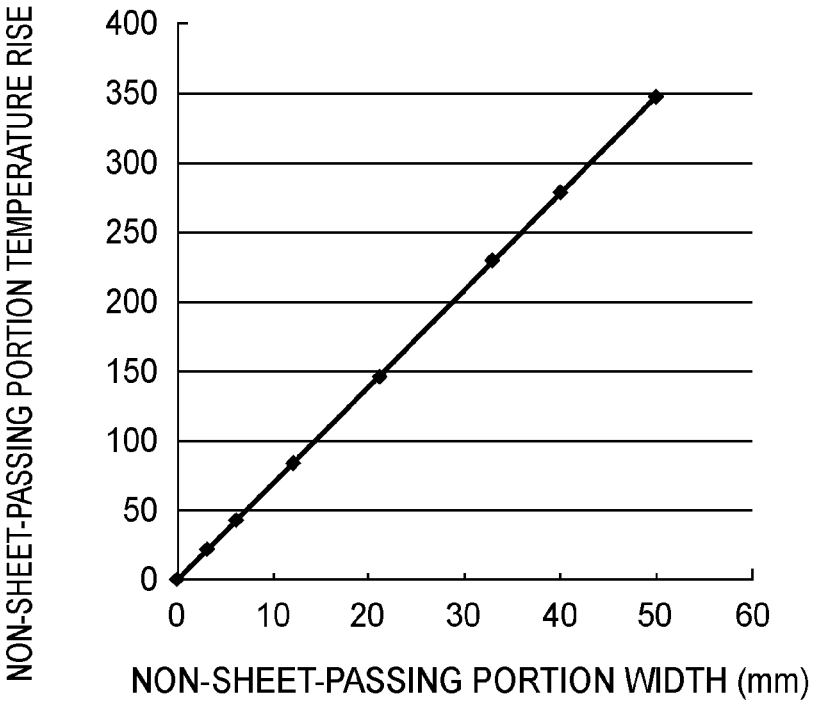
FIG. 9 is a graph showing a relationship between a non-sheet-passing portion width and non-sheet-passing portion temperature rise.

FIG. 9 is a graph showing a relationship between the non-sheet-passing portion width and non-sheet-passing portion temperature rise. For measurement of the non-sheet-passing portion temperature rise, the fixing device A in this embodiment was used and the speed of the belt 603 mounted in the fixing device A was adjusted to 234 mm/sec, and the temperature of the belt 603 was set at 190° C. As the sheet P, papers having various sizes and having weights of 75-81.4 g/m$^2$ were passed through the nip N. A belt surface temperature in the non-passing region when 500 sheets were continuously passed through the nip N was measured.

With a broader non-sheet-passing portion width, a temperature of the non-sheet-passing portion temperature rise becomes higher. Excessive non-sheet-passing portion temperature rise causes degradation and deformation of the holder 601 and the sliding layer by heat in some cases. In this embodiment, by making the temperature of the non-sheet-passing portion temperature rise not more than 230° C., the degradation and the deformation of the holder 601 and the sliding layer by heat are prevented.

As a method of lowering the temperature of the non-sheet-passing portion temperature rise, it is possible to cite a method of lowing a control temperature. However, when the control temperature is lowered, a deposition strength of the toner on the sheet P lowers, so that such a problem of offset that the toner image is peeled off from the sheet P generates in some cases. Further, it would be considered that the number of the heat generating elements is increased, but when the number of the heat generating elements is increased, the width of the heater 600 broadens. Accordingly, there is a need to broaden the nip N, and for that purpose, an outer diameter of the pressing roller 4 is increased, and therefore upsizing of the fixing device, an increase in cost of the fixing device and an increase in rise time generate.

As the method of lowering the temperature of the non-sheet-passing portion temperature rise, in the case where the sheet P having a broad non-sheet-passing portion width is passed through the nip N, a decrease in the number of sheets P passed through the nip N per unit time is effective. This method has less disadvantages, but it takes much time in the case where the sheets are passed through the nip N in a large volume, and therefore this methods leaves such a problem that productivity lowers.

(4) Pressing Roller 4

Figure 10:
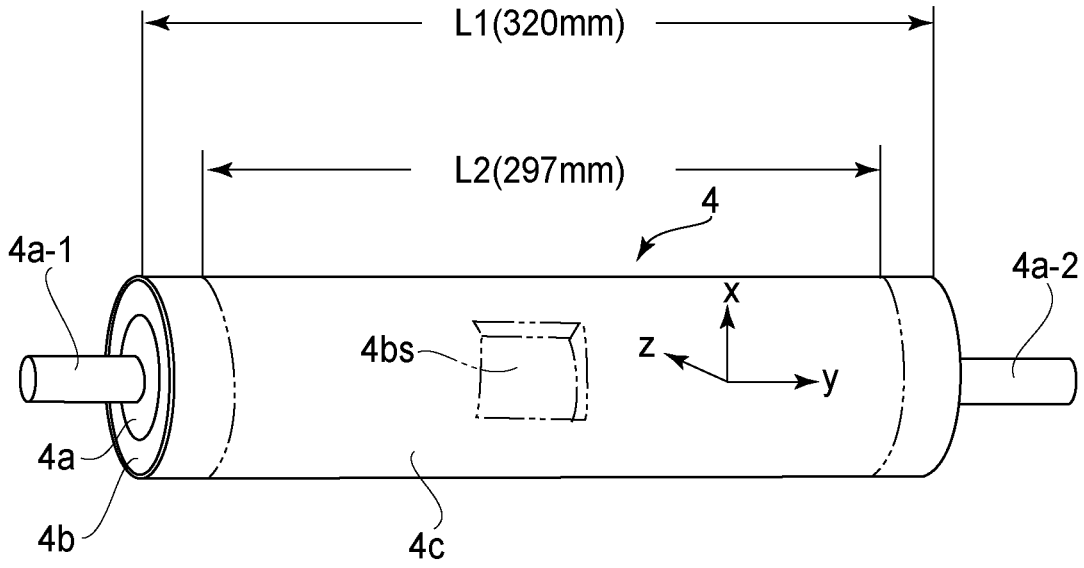
FIG. 10 is a schematic perspective view of a pressing roller.

FIG. 10 is a schematic bird's-eye view (schematic perspective view of an outer appearance) of the pressing roller 4 shown in FIG. 1. The pressing roller 4 shown includes a base material (shaft core member, core metal) 4*a* of iron, aluminum or the like, and an elastic layer 4*b* consisting of a silicone rubber and a parting layer (fluorine-containing resin surface layer) 4*c* consisting of a fluorine-containing resin material or the like.

In the following, a circumferential direction (sheet feeding direction) is represented by "x" direction, a widthwise direction (longitudinal direction, axial direction) of the pressing roller 4 is represented by "y" direction, and a thickness direction (layer thickness direction) of constituent layers of the pressing roller 4 is represented by "z" direction. Further, a combination of the circumferential direction x and the widthwise direction y is a planar direction of the pressing roller 4. L1 represents a (widthwise) dimension (widthwise length) of the pressing roller 4. In this embodiment, the length L1 is 320 mm.

L2 represents a width (dimension with respect to a row direction perpendicular to the sheet feeding direction on the sheet surface) of a maximum width-sized sheet capable of being introduced into the nip N (fixing device A). In this embodiment, the maximum width sized L2 is a width (297 mm) of a A4-sized sheet fed in a long edge (landscape) feeding manner on a so-called center(-line) basis.

An outer diameter of the base material 4*a* is, e.g., 4 mm-80 mm. Small-diameter shaft portions 4*a*-1 and 4*a*-2 are provided in one end-side and the other end-side, respectively, of the base material 4*a* with respect to the widthwise direction so as to be concentric with the base material 4*a*. Each of the small-diameter shaft portions 4*a*-1 and 4*a*-2 is a portion rotatably shaft-supported by an unshown fixing portion such as a frame of the fixing device A.

Figure 13:
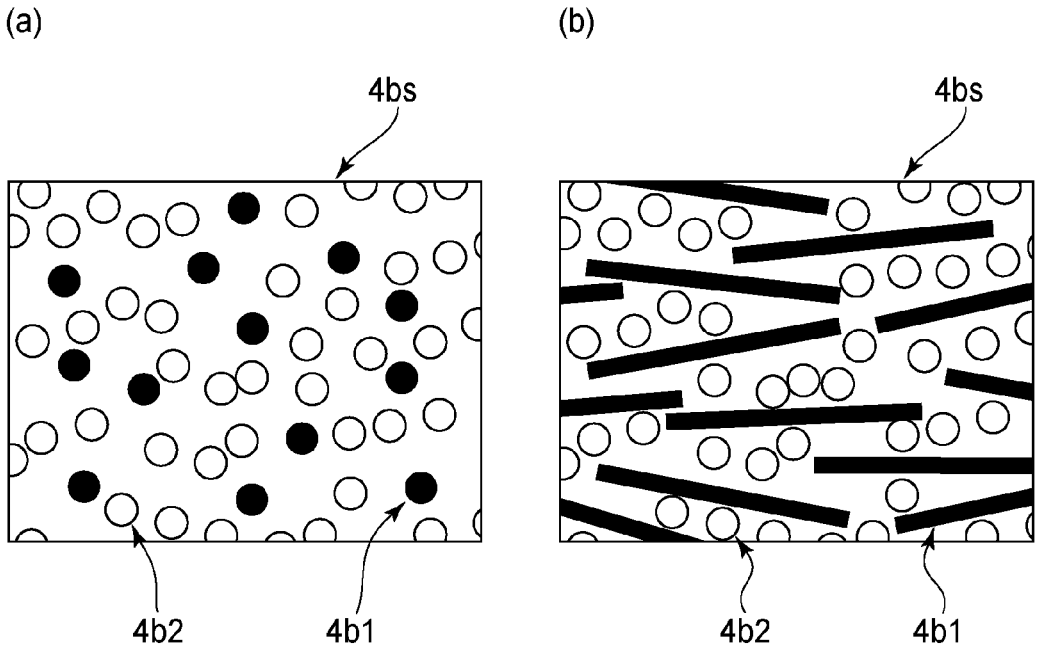
In FIG. 13, (a) is an enlarged sectional view of a-section of the cut sample of FIG. 12, and (b) is an enlarged sectional view of b-section of the cut sample of FIG. 12.

The elastic layer 4*b* contains, as shown in schematic views of (a) and (b) of FIG. 13, a needle-like filler 4*b*1 oriented in the widthwise direction y of the base material 4*a* and a pore (porous portion) 4*b*2. A thickness of the elastic layer 4*b* is not particularly restricted if the nip N having a predetermined width with respect to a sheet feeding direction Q can be formed, but may preferably be 2 mm-10 mm. A thickness of the parting layer 4*c* can be arbitrarily set so long as a sufficient parting property and durability and the like can be imparted to the pressing roller 4. In general, the thickness of the parting layer 4*c* is 20 μm-50 μm.

Figure 11:
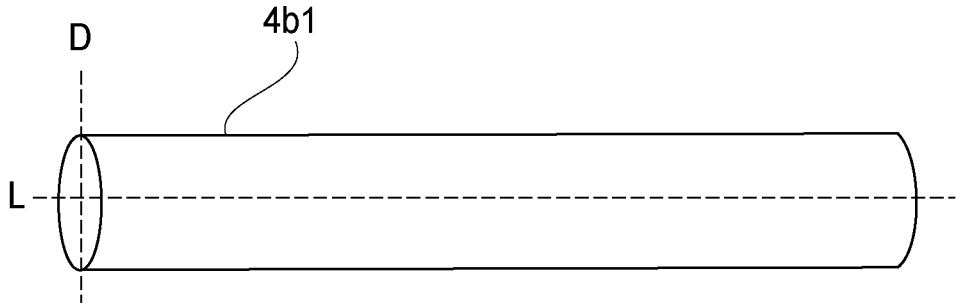
FIG. 11 is a schematic view of a needle-like filler.

Using FIGS. 11-13, the elastic layer 4*b* will be described in further detail. FIG. 11 is an enlarged perspective view of the needle-like filler 4*b*1 which is oriented in the widthwise direction y and exists in the elastic layer 4*b* and which has a diameter D and a length L. Incidentally, a physical property and the like of the needle-like filler 4*b*1 will be described later.

Figure 12:
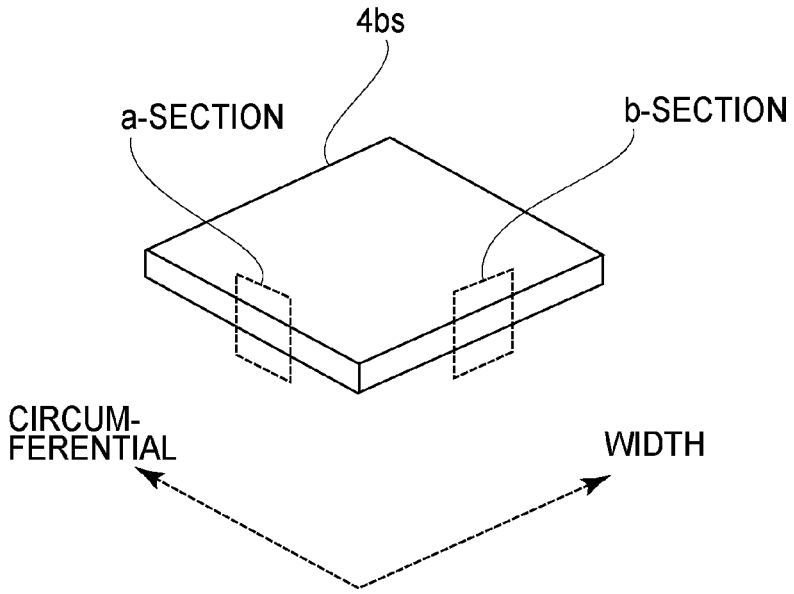
FIG. 12 is an enlarged perspective view of a sample cut from an elastic layer of the pressing roller of FIG. 10.

FIG. 12 is an enlarged view of a cut-out sample 4*bs* cut out from the elastic layer 4*b* shown in FIG. 10. The cut-out sample 4*bs* is cut out along the widthwise direction y and the circumferential direction x as shown in FIG. 10. In FIG. 13, (a) and (b) show a cross section (a-cross section) with respect to the circumferential direction and a cross section (b-cross section) with respect to the widthwise direction, respectively, of the cut-out sample 4*bs*.

In the circumferential cross section (a-cross section) of the cut-out sample 4*bs*, as shown in (a) of FIG. 13, the cross section of a diameter D portion of the needle-like filler 4*b*1 can be principally observed. In the widthwise cross section (b-cross section), as shown in (b) of FIG. 13, a length L portion of the needle-like filler 4*b*1 can be principally observed. The needle-like filler 4*b*1 oriented in the widthwise direction y in the elastic layer 4*b* of the pressing roller 4 constitutes a heat conduction path, so that the thermal conductivity of the pressing roller 4 with respect to the widthwise direction y can be enhanced. Further, in each of (a) and (b) of FIG. 13, the pores 4*b*2 uniformly distributed can be observed.

In this way, a heat conduction property is high with respect to the widthwise direction y of the elastic layer 4*b* by the needle-like filler oriented in the widthwise direction y and the pore 4*b*2 and is low with respect to the thickness direction z by the pore 4*b*2. Further, apparent density lowers by the pore 4*b*2, and therefore volumetric specific heat can be reduced. Incidentally, the apparent density is density based on a volume containing the pores 4*b*2.

As constituent elements for representing features of the elastic layer 4*b*, it is possible to cite a base polymer, the needle-like filler 4*b*1 and the pore 4*b*2. In the following, these elements will be described in order.

(Base Polymer)

The base polymer of the elastic layer 4*b* is obtained by cross-linking and curing an addition curing type liquid silicone rubber. The addition curing type liquid silicone rubber is an uncross-linked silicone rubber including organopolysiloxane (A) having unsaturated bond such as a vinyl group and organopolysiloxane (B) having Si—H bond (hydride). The cross-linking curing proceeds by addition reaction of Si—H with the unsaturated bond such as the vinyl group by heating or the like. As a catalyst for accelerating the reaction, it is in general to incorporate a platinum compound into the organopolysiloxane (A).

Flowability of this addition curing type liquid silicone rubber can be adjusted within a range not impairing an object of the present invention. Incidentally, in the present invention, a filler, a filling material and a compound agent which are not described in the present specification may also be included as a means for solving a known problem so long as amounts of the materials do not exceed ranges of features of the present invention.

(Needle-Like Filler 4*b*1)

The needle-like (elongated fiber-shaped) filler 4*b*1 has thermal conductivity anisotropy that heat is easily conducted in the direction in which the needle-like filler 4*b*1 is oriented (i.e., such a characteristic that the thermal conductivity of the needle-like filler with respect to a long-axis (length) direction is higher than that with respect to a short-axis direction. The "needle-like" refers to a shape having a length with respect to one direction compared with other directions, and the shape can be principally expressed by a short-axis diameter and a long-axis length.

The short-axis diameter (average) is not particularly restricted, but the needle-like filler having the short-axis diameter of 5-15 μm is available relatively easily. Further, the long-axis length (average) may preferably be 0.05 mm-5 mm, more preferably 0.05 mm-1.0 mm.

As shown in FIG. 11, it is possible to use a material having a large ratio of the length L to the diameter D of the needle-like filler, i.e., a high aspect ratio. As a specific shape of the needle-like pitch-based carbon fibers, it is possible to cite a shape of 5-11 μm in diameter D (average diameter) and 50 μm or more and 1000 μm or less in length L (average length) is FIG. 11, for example, and such a material is industrially available easily. In this embodiment, the filler having the aspect ratio in the range of 4.5-200 is used as the needle-like filler. The shape of the bottom of the needle-like filler may be a circular shape or a rectangular shape and is applicable if the needle-like filler is oriented by a molding method described later.

As such a material, it is possible to cite pitch-based carbon fibers. The pitch-based carbon fibers are fibers manufactured from a by-product, as a raw material, such as petroleum, coal or coal tar by carbonization at high temperature. By incorporating the pitch-based carbon fibers having thermal conductivity λ of 500 W/m·K or more, the nip-forming member in the present invention can be suitably used. Further, the pitch-based carbon fibers are a needle-like shape, and therefore features of the nip-forming member in the present invention are suitably exhibited.

The content of the needle-like filler 4b1 in the elastic layer 4b may preferably be 5 volume % or more and 40 volume % or less in order to obtain an expected non-sheet-passing portion temperature rise suppressing effect without lowing the thermal conductivity of the pressing roller 4 with respect to the widthwise direction and also in order to eliminate difficulty in molding of the elastic layer 4b.

The content, the average length and the thermal conductivity of the needle-like filler described above can be obtained in the following manners. In a measuring method of the content (volume %) of the needle-like filler in the elastic layer, first, an arbitrary portion of the elastic layer is cut away, and a volume of the cut-away portion at 25° C. is measured by an immersion specific gravity meter ("SGM-6", manufactured by Mettler-Toredo International Inc.) is used (hereinafter, this volume is referred to as "Vall").

Then, the evaluation sample subjected to the volume measurement is heated at 700° C. for 1 hour in an nitrogen gas atmosphere by using an apparatus for thermogravimetry (trade name: "TGA851e/SDTA", manufactured by Mettler-Toredo International Inc.), so that the silicone rubber component is decomposed and removed. In the case where in addition to the needle-like filler, an inorganic filler is incorporated in the elastic layer, a residual matter after the decomposition is in a state in which the needle-like filler and the inorganic filler exist in mixture.

In this state, the volume at 25° C. is measured a dry-type automatic density meter (trade name: "AccuPyc 13301", manufactured by Shimadzu Corp.) (hereinafter, this volume is referred to as "Va"). Thereafter, the residual matter is heated at 700° C. for 1 hour in an air atmosphere, so that the needle-like filler is thermally decomposed and removed. The volume of the remaining inorganic filler at 25° C. is measured using the dry-type automatic density meter (trade name: "AccuPyc 1330-1", manufactured by Shimadzu Corp.) (hereinafter, this volume is referred to as "Vb"). Based on these values, the weight of the needle-like filler can be obtained from the following equation:

$$\text{Volume(volume \%) of needle-like filler}=\{(Va-Vb)/Vall\}\times 100.$$

The average length of the needle-like filler can be obtained by an ordinary method through microscopic observation of the needle-like filler after the removal of the silicone rubber component by heat described above.

The thermal conductivity of the needle-like filler can be obtained from thermal diffusivity, specific heat at constant pressure and density by the following formula:

$$\text{Thermal conductivity}=\text{Thermal diffusivity}\times\text{Specific heat at constant pressure}\times\text{Density}.$$

The thermal diffusivity is obtained by a laser flash method thermal constant measurement system (trade name: "TC-7000", ADVANCE RIKO, Inc.). The specific heat at constant pressure is obtained by a differential scanning calorimeter (trade name: "DSC823e", manufactured by Hitachi High-Tech Science Corp.). The density is obtained by the dry-type automatic density meter (trade name: "AccuPyc 1330-1", manufactured by Shimadzu Corp.).

Incidentally, with respect to each of the content, the average length and the thermal conductivity of the needle-like filler in this embodiment, an average of measured values of 5 cut-out samples is employed.

(Pore 4b2)

In the elastic layer 4b, the oriented needle-like filler 4b1 and the pore 4b2 are co-exist.

Depending on a pore-forming means such as a foaming agent or hollow particles, needle-like filler orientation inhibition generated in some cases. An orientation state of the needle-like filler 4n1 dominates the thermal conductivity with respect to the widthwise direction, and therefore when the orient is inhibited, an effect of suppressing the non-sheet-passing portion temperature rise is unpreferably lowered.

On the other hand, in the case where the pore is formed by using the water-containing material, a degree of the orientation inhibition of the needle-like filler co-existing with the water-containing material can be reduced. A mechanism for compatibly realizing the orientation of the needle-like filler 4b1 in the widthwise direction y and the pore formation is not clarified.

However, there is no hard shell such as the hollow particles described above and a diameter of the pore in a water-containing gel dispersion state can be made small, and therefore it would be considered that the influence on the orientation inhibition of the needle-like filler 4b1 during the flow is small. Incidentally, from the viewpoints of strength and image quality, a pore diameter may preferably be less than 20 μm.

A porosity of the elastic layer 4b may preferably be 20 volume % or more and 70 volume % or less in order to obtain an expected rise time shortening effect and in order to eliminate difficulty in molding. When the porosity is high, the rise time can be shortened, so that the porosity may more preferably be 35 volume % or more and 70 volume % or less.

The porosity in a region from a surface of the elastic layer 4b to a position of 500 μm in depth from the surface can be obtained by a formula shown below. First, using a razor, the region from the surface of the elastic layer 4b to the position of 500 μm in depth from the surface in an arbitrary plane is cut away. A volume of the cut-away region at 25° C. is measured by the immersion specific gravity meter ("SGM-6", manufactured by Mettler-Toredo International Inc.) is used ("Vall" described above). Then, the evaluation sample subjected to the volume measurement is heated at 700° C. for 1 hour in an nitrogen gas atmosphere by using an apparatus for thermogravimetry (trade name: "TGA851e/SDTA", manufactured by Mettler-Toredo International Inc.). As a result, the silicone rubber component is decomposed and removed (Hereinafter, a decrease in weight at this time is referred to as "Mp").

In the case where in addition to the needle-like filler, an inorganic filler is incorporated in the elastic layer, a residual matter after the decomposition is in a state in which the needle-like filler and the inorganic filler exist in mixture.

In this state, the volume at 25° C. is measured the dry-type automatic density meter (trade name: "AccuPyc 13301", manufactured by Shimadzu Corp.) ("Va" described above).

Based on these values, the porosity (pore amount) can be obtained from the formula shown below. Incidentally, the density of the silicone polymer was 0.97 g/m$^3$ for calculation (hereinafter, this density is referred to as "pp").

$$\text{Porosity(volume \%)}=[\{Nall-(Mp/pp+Va)\}/Vall]\times 100$$

Further, the porosity of the elastic layer 4b can be measured similarly as described above by cutting away a sample from the elastic layer 4b in an arbitrary plane. Incidentally, as the porosity in this embodiment, an average of measured values of 5 cut-away samples is employed.

(Ratio of Widthwise Direction Thermal Conductivity λ1 to Thickness Direction Thermal Conductivity λ2)

The elastic layer 4b has a ratio Δ1/Δ2 which is a ratio of the widthwise direction thermal conductivity λ1 to the thickness direction thermal conductivity λ2 (hereinafter, this ratio is referred to a "thermal conductivity ratio α) of 6 or more and 900 or less. That is, the needle-like filler 4b1 is oriented in the elastic layer so that the thermal conductivity λ1 of the elastic layer 4b with respect to the longitudinal direction is 6 times or more and 900 times or less the thermal conductivity λ2 of the elastic layer 4*b* with respect to the thickness direction.

When the thermal conductivity ratio α is less than 6, the non-sheet-passing portion temperature rise suppressing effect cannot be obtained sufficiently in some cases, and in order to increase the thermal conductivity ratio α to more than 900, the amount and the porosity of the needle-like filler are increased, so that it is difficult to effect machining and molding.

With a higher thermal conductivity ratio, heat dissipation in the thickness direction z is suppressed while uniformizing the heat with respect to the widthwise direction y, and therefore the higher thermal conductivity ratio is suitable for shortening the rise time while suppressing the non-sheet-passing portion temperature rise.

Incidentally, the thermal conductivity ratio α can be obtained in the following manner. First, cut-away samples 4*bs* (FIG. 12) of the elastic layer 4*b* were cut out from the pressing roller 4 with a razor. Then, by a method described below, the widthwise direction thermal conductivity λ1 and the thickness direction thermal conductivity λ2 were measured 5 times, and an average of measured values of each of the thermal conductivity λ1 and the thermal conductivity λ2 was used, so that a ratio of λ1 to λ2 was calculated.

Figure 14:
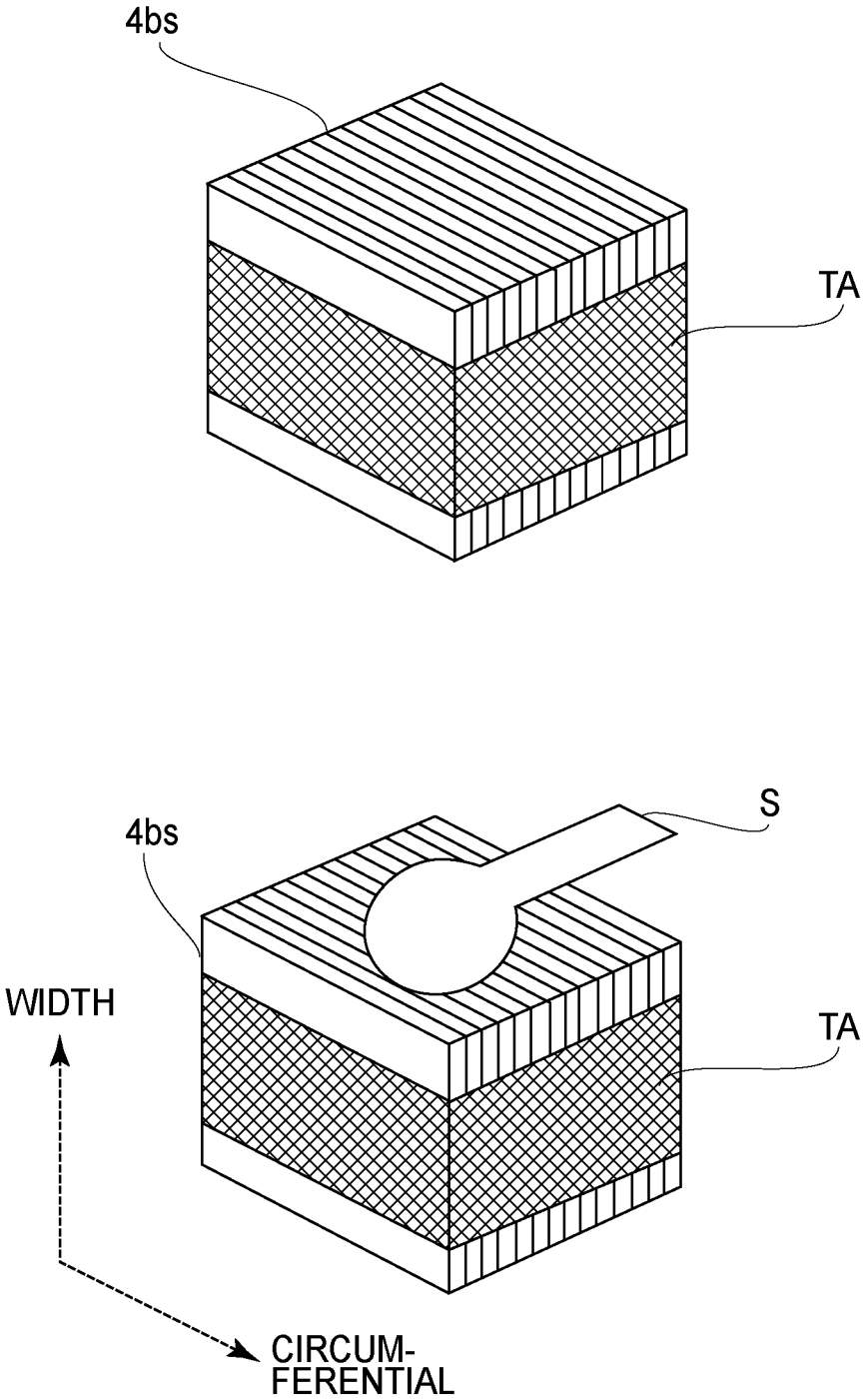
FIG. 14 is an illustration of thermal conductivity measurement of the cut sample of an elastic layer.

Using FIG. 14, the measurement of the widthwise direction thermal conductivity λ1 and the thickness direction thermal conductivity λ2 of the elastic layer 4*b* will be described. FIG. 14 shows a sample for thermal conductivity evaluation prepared by superposing cut-out samples 4*bs* each having a size of 15 mm (circumferential direction)×15 mm (widthwise direction)×elastic layer thickness (thickness direction) so as to have a thickness of about 15 mm. When the widthwise direction thermal conductivity λ1 was measured, as shown in FIG. 14, the sample to be measured was fixed by a tape TA of 0.07 mm in thickness and 10 mm in width to prepare a set of the samples 4*bs*. Then, in order to uniformize flatness of the surface to be measured, the surface to be measured and an opposite surface thereof are cut with the razor.

In this way, two sample sets to be measured are prepared, and a sensor S is sandwiched between the two sample sets, and then measurement was made. The measurement is anisotropic thermal conductivity measurement using a hot disk method thermophysical property measuring device ("TPA-501, manufactured by Kyoto Electronics Manufacturing Co., Ltd.). In the measurement of the thickness direction thermal conductivity λ2, the direction of the sample to be measured was changed and then the measurement was made in the same manner as described above.

(Volume Specific Heat in Region from Surface of Elastic Layer 4*b* to Position of 500 μm in Depth from Elastic Layer Surface)

The elastic layer 4*b* has volume specific heat, in a region from the surface of the elastic layer 4*b* to a position of 500 μm in depth from the elastic layer surface, of 0.5 J/cm$^3$·K or more and 1.2 J/cm$^3$·K or less. With a lower volume specific heat, the rise time can be shortened, and therefore the volume specific heat may preferably be 0.5 J/cm$^3$·K or more and 1.0 J/cm$^3$·K or less. A thermal osmosis distance (depth) of the pressing roller 4 to be subjected to repetitive heating for a short time (20-80 msec in general) at the nip N is shallow, and is about 500 μm in depth from the surface of the elastic layer 4*b*. In that thickness region, the volumetric specific heat is made small, so that heat accumulation from the fixing film 3 into the pressing roller 4 is prevented and thus the fixing film 3 can be efficiently increased in temperature and it is possible to shorten the rise time.

When the volumetric specific heat is less than 0.5 J/cm$^3$·K, the porosity is required to be made large and thus it is difficult to effect machining and molding. When the volumetric specific heat is more than 1.2 J/cm$^3$·K, an expected rise time shortening effect cannot be obtained in some cases.

The volumetric specific heat in the region from the surface of the elastic layer 4*b* of the pressing roller 4 to the position of 500 μm in depth from the elastic layer surface can be obtained in the following manner.

First, an evaluation sample (unshown) is cut out so as to have a depth of 500 μm from the surface of the elastic layer 4*b* of the pressing roller 4. Then, measurement of specific heat at constant pressure and measurement of immersion specific gravity are made. The specific heat at constant pressure can be obtained, e.g., by the differential scanning calorimeter (trade name: DSC823e, manufactured by Mettler-Toredo International Inc.). Further, the apparent density can be obtained using, e.g., the immersion specific gravity meter ("SGM-6", manufactured by Mettler-Toredo International Inc.). From the thus-measured specific heat at constant pressure and apparent density, the volumetric specific heat can be obtained by the following formula:

Volume specific heat=specific heat at constant pressure×apparent density.

(5) Manufacturing Method of Pressing Roller 4

(i) Liquid Composition Compounding Step

The above-described needle-like filler 4*b*1 and a water-containing material obtained by incorporating water in a water-absorptive polymer are compounded with an uncrosslinked addition-curing type silicone rubber. The compounding can be made by weighing a predetermined of each of the uncrosslinked addition-curing type silicone rubber, the needle-like filler 4*b*1 and the water-containing material and then by dispersing the needle-like filler 4*b*1 in the mixture by a known filler mixing and stirring means such as a planetary universal mixing and stirring device.

(ii) Liquid Composition Layer Forming Step

1) Metal Mold

Figure 15:
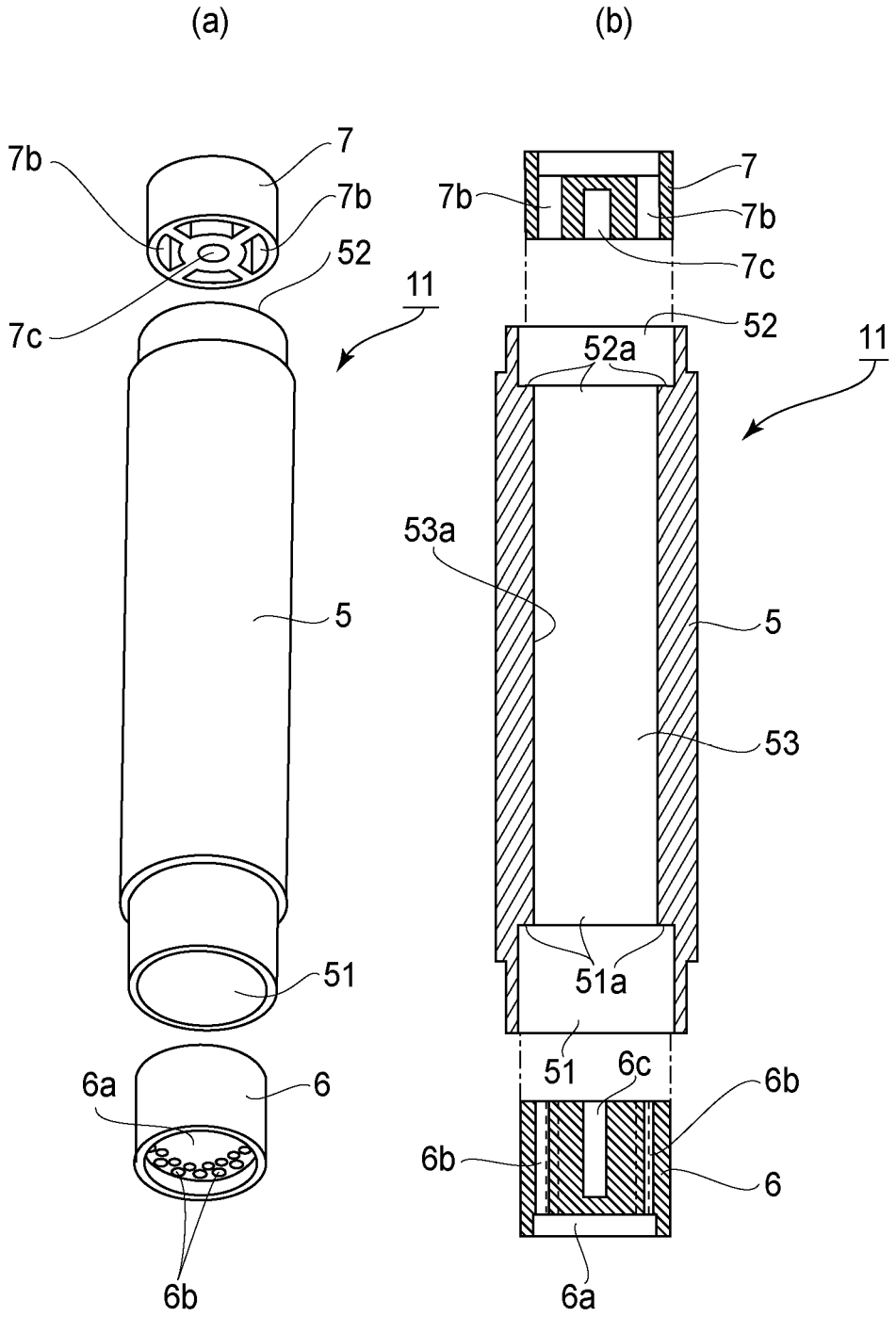
In FIG. 15, (a) and (b) are illustrations of a structure of a metal mold.

In FIG. 15, (a) is an exploded perspective view of a metal mold 11 used in casting manufacturing of the pressing roller 4 in this embodiment, and (b) is a longitudinal sectional view of a hollow metal mold 5, a one end-side piece mold (inserting mold) 6 and the other end-side piece mold (inserting mold) 7, which constitute the metal mold 11. The metal mold 11 includes the hollow metal mold (hollow cylindrical metal mold, pipe-like cylindrical mold) 5 having a cylindrical molding space (hereinafter referred to as a cavity) 53, and the one end-side piece mold 6 and the other end-side piece mold 7 mounted into a one end-side opening 51 and the other end-side opening 52, respectively, of the hollow metal mold 5.

The one end-side piece mold 6 is a piece mold for permitting injection of the liquid rubber into the cavity 53 of the hollow metal mold 5. The other end-side piece mold 7 is a piece mold for permitting discharge of air pushed out from the inside of the cavity 53 with the injection of the liquid rubber into the cavity 53.

Figure 16:
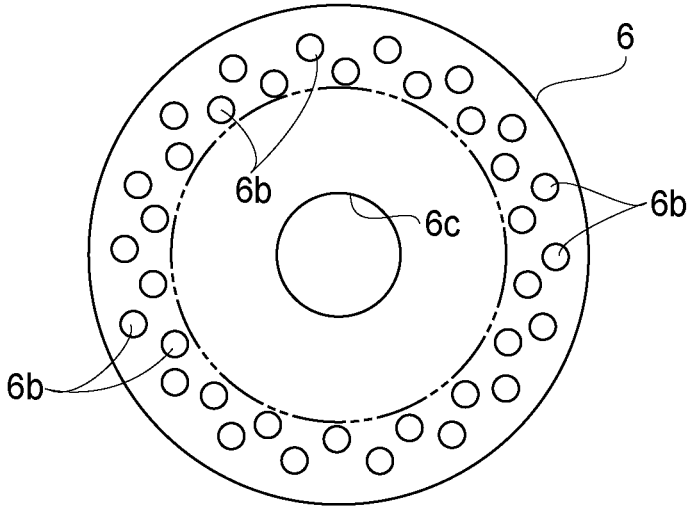
In FIG. 16, (a) and (b) show a shape of injection holes provided in one end-side piece mold (inserting mold).
Figure 16:
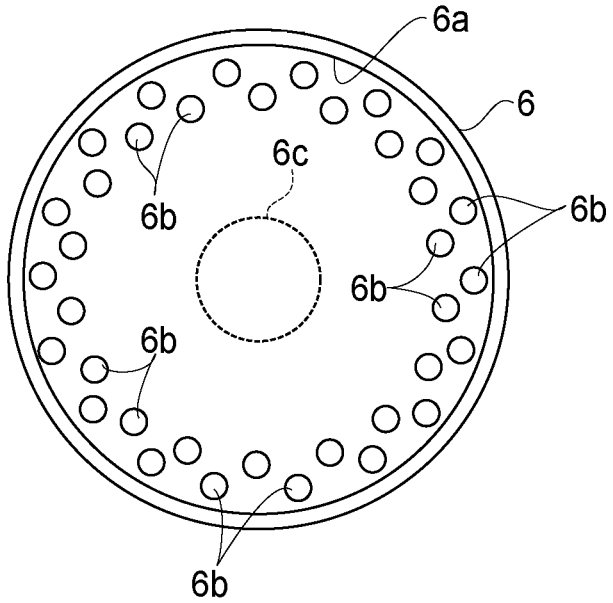

In FIG. 16, (a) is an inner surface view (cavity-side end surface view) of the one end-side piece mold 6, and (b) is an outer surface view (end surface view in a side opposite from the cavity side) of the one end-side piece mold 6. At a central portion of the one end-side piece mold 6 in an inner surface side, a central hole 6*c* as a base material holding portion into which the one end-side small-diameter shaft portion 4*a*-1 of the base material 4*a* is to be inserted is provided. Further, in the outer surface side, a circumferential hole (hollow, recessed portion) 6*a* is provided. Further, the circumferential hole 6*a* is provided with a plurality of liquid rubber mixture injection holes 6*b* which are disposed from the outer surface side to the inner surface side along a circumference of the circumferential hole 6*a*.

Further, at an inner surface central portion (cavity-side end surface central portion) of the other end-side piece mold 7, a central hole 7*c* as a base material holding portion into which the other end-side small-diameter shaft portion 4*a*-2 of the base material 4*a* is to be inserted is provided. Then, a plurality of discharging holes 7*b* are provided from the inner surface side to the outer surface side.

The one end-side piece mold 6 is engaged into the one end-side opening 51 from the inner surface side and is inserted sufficiently until a circumferential edge portion in the inner surface side is abutted against and received by a circular stepped portion 51*a* on an inner peripheral surface of the opening, so that the one end-side piece mold 6 is mounted in the one end-side of the hollow metal mold 5. Further, the other end-side piece mold 7 is engaged into the other end-side opening 52 from the inner surface side and is inserted sufficiently until a circumferential edge portion in the inner surface side is abutted against and received by a circular stepped portion 52*a* on an inner peripheral surface of the opening, so that the one end-side piece mold 6 is mounted in the other end-side of the hollow metal mold 5.

2) Placement of Base Material in Metal Mold

The base material 4*a* was subjected to known primer treatment in advance at a portion where the rubber elastic layer 4*b* is to be formed. In the case where the elastic layer 4*b* and the base material 4*a* are interlayer-bonded to each other, the primer may also be not used.

Figure 17:
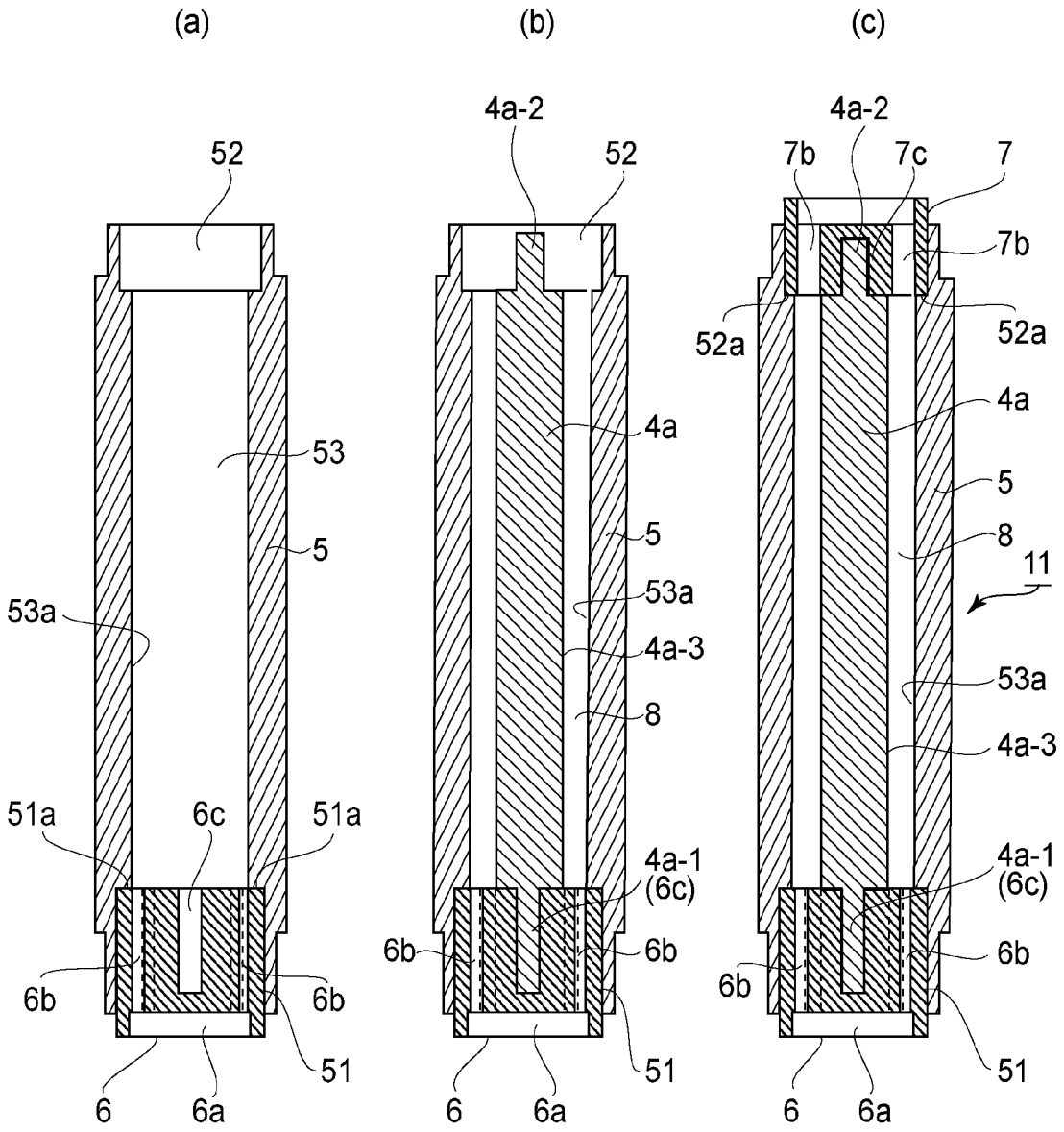
In FIG. 17, (a)-(c) are illustrations of a manner of mounting a roller base material in the metal mold.

As shown in (a) of FIG. 17, the one end-side piece mold 6 is mounted into the one end-side opening 51 of the hollow metal mold 5. Then, as shown in (b) of FIG. 17, the above-described base material 4*a* is inserted into the hollow metal mold 5 through the other end side opening 52 from the one end-side small-diameter shaft portion 4*a*-1 side, and then the small-diameter shaft portion 4*a*-1 is inserted into and supported by the inner surface-side central hole 6*c* of the one end-side piece mold 6.

Then, as shown in (c) of FIG. 17, the other end-side piece mold 7 is mounted into the hollow metal mold 5 through the other end side opening 52 in a state in which the other end-side small-diameter shaft portion 4*a*-2 of the base material 4*a* is inserted into and supported by the inner surface-side central hole 7*c*.

As a result, the base material 4*a* is concentrically positioned and held at the cylindrical central portion of the cylindrical cavity 53 of the metal mold 5 in a state in which the one end-side and the other end-side small-diameter shaft portions 4*a*-1 and 4*a*-2 are supported by the central holes 6*c* and 7*c* of the one end-side and the other end-side piece molds 6 and 7, respectively. Further, between a cylinder molding surface (inner peripheral surface) 53*a* of the cylindrical cavity 53 and an outer surface (outer peripheral surface) 4*a*-3 of the base material 4*a*, a gap (spacing) 8 for permitting cast molding of the rubber elastic layer 4*b* having a predetermined thickness is formed around the outer periphery of the base material 4*a*.

Incidentally, the placement of the base material 4*a* in the cavity 53 of the metal mold 11 is not limited to the above-described procedure. The hollow metal mold 5, the base material 4*a*, the one end-side piece mold 6 and the other end-side piece mold 7 may only be finally assembled as shown in (c) of FIG. 17.

3) Mounting of Metal Mold 11

Figure 18:
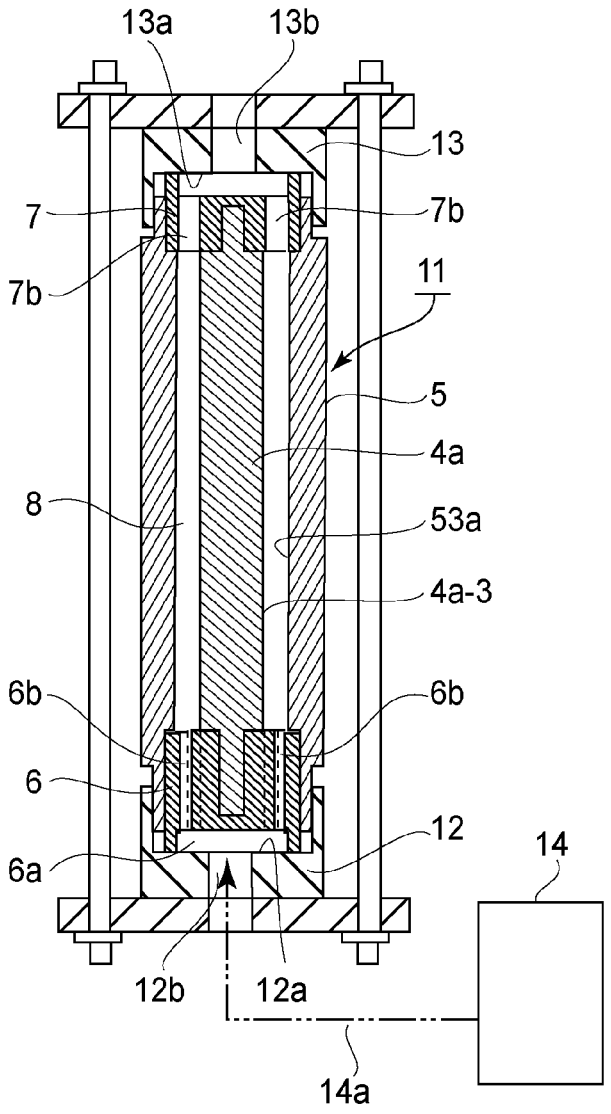
FIG. 18 is an illustration of an injection step.

The metal mold 11 in which the base material 4*a* is provided in the cavity 53 as described above is, as shown in FIG. 18, pressed and fixedly held in a vertical attitude between a lower-side jig 12 and an upper-side jig 13 which oppose each other while the one end-side piece mold 6 side is a lower side and the other end-side piece mold 7 side is an upper side. The one end-side piece mold (hereinafter referred to as a lower piece mold) 6 of the metal mold 11 is engaged into and received by a receiving hole 12*a* of the lower-side jig 12. The other end-side piece mold (hereinafter referred to as an upper piece mold) 7 of the metal mold 11 is engaged into and received by a receiving hole 13*a* of the upper-side jig 13.

That is, the metal mold 11 is fixedly held between the lower-side jig 12 and the upper-side jig 13 in an attitude state in which a cylindrical axial line of the cylindrical cavity 53 is vertically directed and a side where the injection holes 6*b* are disposed is the lower side, and then a casting step is performed. At a central portion of the receiving hole 12*a* of the lower-side jig 12, a liquid composition injection port 12*b* is provided. To the liquid composition injection port 12*b*, a liquid composition supplying pipe 14*a* of an external liquid composition supplying device 14 is connected. At a central portion of the receiving hole 13*a* of the upper-side jig 13, a discharging port 13*b* is disposed.

4) Injection of Liquid Composition

The supplying device 14 is driven, and the liquid composition of (i) described above passes through the supplying pipe 14*a* and enters the receiving hole 12*a* through the injection port, so that the liquid composition is filled in a space portion constituted by the receiving hole 12*a* and the circumferential hole 6*a* in the outer surface side of the lower piece mold 6. With subsequent supply of the liquid composition, the filled liquid composition passes through the plurality of injection holes 6*b* provided along the circumference of the circumferential hole 6*a* and flows from the outer surface side toward the inner surface side of the lower piece mold 6. Then, the liquid composition is injected into the gap 8 formed between the cylinder molding surface 53*a* of the cavity 53 and the outer surface 4*a*-3 of the base material 4*a*.

With further subsequent supply of the liquid composition, the injection of the liquid composition into the gap 8 has advanced from below to above. Air existing in the gap 8 is pushed up from below in the gap 8 with the injection of the liquid composition into the gap 8 from below toward above, so that the liquid composition passes from the gap 8 through a discharging hole 7*b* of the upper piece mold 7 and the discharging port 13*b* of the upper-side jig 13, and comes out of the metal mold 11.

The injection of the liquid composition into the gap 8 through the respective injection holes 6*b* of the lower-side piece mold 6 is averagely made with respect to a circumferential direction of the gap 8. In addition, the base material 4*a* is in a state in which the base material 4*a* is concentrically fixed at the cylindrical central portion of the cavity 53 by the upper and lower members 7 and 6, and is not moved by the injection of the liquid composition, so that the gap 8 can be filled with the liquid composition adequately without generating thickness deviation (non-uniformity).

In the above-described manner, the liquid composition is casted in the metal mold 11 in which the base material 4*a* is disposed while providing flowability in the widthwise direction y and the circumferential direction x. By this flow of the liquid composition during the injection, most of the needle-like filler 4*b*1 contained in the liquid composition is oriented in the widthwise direction y of the base material 4*a*, i.e., the longitudinal direction (y direction) of the pressing roller 4 along the flow of the liquid composition. As a result, the thermal conductivity of the pressing roller 4 with respect to the widthwise direction y and the circumferential direction x (planar direction xy) is effectively enhanced.

The injection of the liquid composition into the metal mold 11 is performed at least until the gap 8 is sufficiently filled with the liquid composition. The discharging hole 7*b* of the upper piece mold 7 is not required to the sufficiently filled with the liquid composition. Incidentally, the liquid composition layer forming method is not restricted to the above method if the method is a method capable of forming a layer while giving flowability to the liquid in the widthwise direction y.

(iii) Silicone Rubber Component Cross-Linking Curing Step

After the injection of the liquid composition (after the end of the casting step), the metal mold 11 is demounted from the upper and lower jigs 13 and 12. At this time, outer openings of the lower piece mold 6 and the upper piece mold 7 are hermetically sealed by mounting of a blind plate so that the injected liquid rubber does not flow through the outer openings of the lower piece mold 6 and the upper piece mold 7. Then, in the hermetically sealed state of the metal mold 11, heat treatment is made at a temperature of not more than a boiling point of water for 5 minutes to 120 minutes. As a heat treatment temperature, 60° C. to 90° C. is desirable, so that the silicone rubber component is cross-linked and cured. The metal mold 11 is in the hermetically sealed state, and therefore the silicone rubber component can be cross-linked and cured while maintaining water content of the water-containing material.

Before the silicone rubber component is cured, in a water vaporization step described later, a non-foam layer (skin layer) having no pore is formed. This skin layer is higher in density than a portion made porous by foaming, and therefore is high in volumetric specific heat, so that the skin layer is not preferable from the viewpoint of the rise time shortening. For that reason, this step may desirably be performed in a state in which the metal mold is hermetically sealed.

(iv) Demolding Step

The metal mold 11 is appropriately cooled with water or air, and then the base material 4*a* on which the liquid composition layer after being subjected to the cross-linking curing is laminated is removed from the metal mold 11.

The demolding is made by removing the lower piece mold 6 and the upper piece mold 7 through the one end-side opening 51 and the other end side opening 52, respectively, of the hollow metal mold 5. This removal is made against bond strength of association portion (connecting portion) between an end surface of the cured liquid composition layer in the hollow metal mold 5 and the cured liquid composition layer in the holes 6*b* and 7*b* in the lower piece mold 6 and the upper piece mold 7, respectively. Further, from the hollow metal mold 11, the base material 4*a* on which the cured liquid composition layer is laminated is pulled out.

Then, the pulled-out base material 5*a* is subjected to reforming for removing burrs and irregularity portion remaining on sizes thereof in the one end-side and the other end-side.

(v) Dewatering Step

The cured liquid composition layer laminated on the base material 4*a* is dewatered by a heating process, so that the pores 4*b*2 is formed (in this step, the water in the water-containing material is vaporized from the layer obtained by the cross-linking of the rubber to form a porous elastic layer). As a heating process condition, 100° C.-250° C. and 1-5 hours are desirable.

By this dewatering step, the cured liquid composition layer laminated on the base material 4*a* becomes the porous elastic layer 4*b* containing the needle-like filler 4*b*1 and the pore portion 4*b*2 by the vaporization of the water. By forming the pores 4*b*2 in the elastic layer 4*b*, it is possible to obtain an effect of lowering the thermal conductivity of the pressing roller 4 with respect to the thickness device z. Further, the thermal capacity can also be made small. On the other hand, as for the thermal conductivity with respect to the widthwise direction y, the needle-like filler 4*b*1 constitutes a heat conduction path, so that the thermal conductivity is maintained at a high level compared with the thermal conductivity with respect to the thickness device z.

As described above, it becomes possible to form the elastic layer 4*b* which is high in thermal conductivity with respect to the widthwise direction y and which has the thermal conductivity lower with respect to the thickness device z than with respect to the widthwise direction y.

(vi) Lamination Step of Parting Layer

Figure 19:
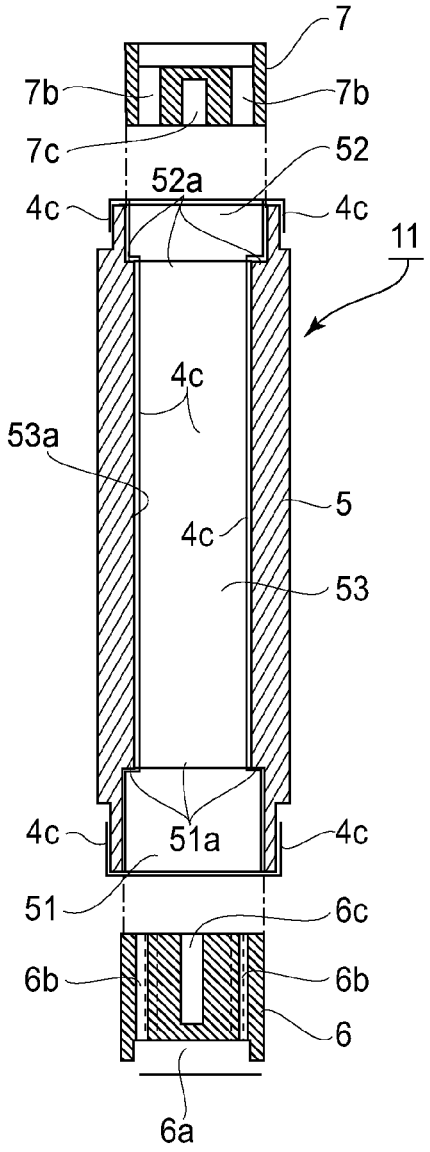
FIG. 19 is a schematic view of a state in which a fluorine-containing resin tube is disposed on an inner surface (forming surface) of the metal mold in advance.

Using an adhesive, on the elastic layer 4*b*, as the parting layer 4*c*, the fluorine-containing resin-made tube is coated and provided integrally with the elastic layer 4*b*. In the case where the elastic layer 4*b* and the parting layer 4*c* are inter-layer-bonded to each other without using the adhesive, the adhesive may also be not used. Incidentally, the parting layer 4*c* is not necessarily required to be formed finely in the steps. As shown in FIG. 19, the tube 4*c* to be used as the parting layer is disposed on an inner surface (molding surface) of the metal mold 5 in advance. Then, in the metal mold 5, the base material 4*a* is disposed in the manner shown in FIGS. 17 and 18. In this state, the liquid composition is casted in the metal mold 11. By such a method, the parting layer 4*c* can be laminated. Further, after the elastic layer 4*b* is formed, the parting layer 4*c* can also be formed by a known method such as coating with a fluorine-containing resin material.

Here, a parting agent is applied onto a liquid contact surface of each of the lower piece mold 6 and the upper piece mold 7 in advance, and after the demolding, the liquid rubber remaining in each of the piece molds is removed, and then each of the piece molds is used again. When the parting agent is applied in advance, removal of the cured rubber remaining on the associated piece mold is easy. Also onto the molding surface 53*a* of the hollow metal mold 5, the parting agent is applied, whereby the demolding after the rubber curing becomes easy. Further, in the casting step, the metal mold 11 may also assume a horizontal (lateral) attitude or an upside-down attitude. However, in the horizontal attitude or the upside-down attitude, there is a liability that the air is incorporated during the liquid composition injection, and therefore the attitude in which the injection side is positioned in the lower side is preferable.

In this embodiment, the following materials were used. As the base material 4*a*, an iron-made core metal of 320 mm in widthwise length of the rubber-laminated portion was used. The water-containing material is prepared by incorporating water into "REOGIC 250H" (manufactured by Toagosei Co., Ltd.). The amount of "REOGIC 250H" was adjusted at 1 wt. % per the water-containing material. As the parting layer 4*c*, a 50 μm-thick PFA fluorine-containing resin tube (manufactured by Gunze Limited) which has been treated at an inner surface thereof in advance was used.

As the needle-like filler 4*b*1, the pitch-based carbon fibers shown below were used.

<Trade name: XN-100-25M (manufactured by Nippon Graphite Fiber Co., Ltd.)>

Average fiber diameter: 9 μm

Average fiber length L: 150 μm

Thermal conductivity: 900 W/(m·K)

This needle-like filler was prepared so as to be contained in an amount of 5 volume % in the elastic layer 4*b*. Further, the porosity was adjusted to 60 volume %.

Incidentally, in this embodiment, bonding between the elastic layer 4*b* and the base material 4*a* and between the elastic layer 4*b* and the parting layer 4*c* is made by the following materials. For the bonding between the elastic layer 4*b* and the base material 4*a*, liquid A and liquid B of "DY39-051" (trade name, manufactured by Dow Corning Toray Co., Ltd.) was used, and for the bonding between the elastic layer 4*b* and the parting layer 4*c*, liquid A and liquid B of "SE1819CV" (trade name, manufactured by Dow Corning Toray Co., Ltd.) was used. In this embodiment, the following steps were performed. In a liquid composition compounding step, the liquid composition was obtained using various materials as described above. Then, the liquid composition was mixed by a universal mixing and stirring device, and the liquid composition for forming the elastic layer was casted into a pipe-shaped cylindrical mold of 25 mm in diameter in which a primer-treated base material 4*a* was disposed, and then the mold was hermetically sealed. In a silicone rubber component curing step, heat treatment was performed in a hot-air oven under a condition of 90° C. and 1 hour. Then, the liquid composition for forming the elastic layer was casted into a pipe-shaped cylindrical mold of 30 mm in diameter in which the base material 4*a* on which the above elastic layer was formed was disposed, and then the mold was hermetically sealed. In a silicone rubber component curing step, heat treatment was performed in a hot-air oven under a condition of 90° C. and 1 hour. Then, in a dewatering step, water cooling and demolding were made in advance and the heat treatment was performed in the hot-air oven under a condition of 200° C. and 4 hours. Finally, as the parting layer 4*c*, the PFA fluorine-containing resin material was coated on the elastic layer 4*b* by using the above-described adhesive (bonding agent).

COMPARISON EXAMPLES

A comparison between the fixing device A in this embodiment and fixing devices in Comparison Examples was made.

Comparison Example 1

In place of the above-described liquid composition in the above embodiment, such an addition curing-type silicone rubber that the needle-like filler and the water-containing material were not contained and that the elastic layer 4*b* was 0.4 W/(m·K) in thermal conductivity was used for the pressing roller 4.

The manufacturing process was the same as that in the above-described embodiment, so that the pressing roller 4 in Comparison Example 1 was obtained. Incidentally, in Comparison Example 1, the pressing roller 4 was manufactured without containing the needle-like filler and the water-containing material, and therefore the elastic layer 4*b* does not include the needle-like filler and the pores.

Comparison Example 2

In place of the above-described liquid composition in the above embodiment, such an addition curing-type silicone rubber that the needle-like filler and the water-containing material were not contained and that the elastic layer 4*b* was 2.5 W/(m·K) in thermal conductivity was used for the pressing roller 4.

The manufacturing process was the same as that in the above-described embodiment, so that the pressing roller 4 in Comparison Example 2 was obtained. Incidentally, in Comparison Example 2, the pressing roller 4 was manufactured without containing the needle-like filler and the water-containing material, and therefore the elastic layer 4*b* does not include the needle-like filler and the pores.

(Member Evaluation)

For evaluation of the non-sheet-passing portion temperature rise the fixing device A (FIGS. 1 and 3) in the above embodiment was used. A speed of the belt 603 mounted in the fixing device A was adjusted to 234 mm/sec, and a temperature of the belt 603 was set at 190° C. The paper passed, as the sheet P, through the nip N of the fixing device A was executive-sized paper cut from Hammermill Great White Copy Paper having a basis weight of 75 g/m$^2$). The surface temperature of the belt 603 in the non-sheet-passing region when 500 sheets are passed was measured.

Evaluation of the rise time of the fixing device A (FIGS. 1 and 3) was made by measuring a time from turning-on of a heater switch until the surface temperature of the belt 603 reached 180° C. in an idling state in which the sheet was not passed through the fixing device A.

With respect to each of fixing devices in the above-described embodiment (present invention) and Comparison Examples 1 and 2, physical properties of the elastic layer 4*b* of the associated pressing roller 4, and the temperature of the non-sheet-passing portion temperature rise and a rise time of the associated fixing device are shown in Table 1.

TABLE 1

| | LTC*1 | TTC*2 | TCR*3 | TR*4 | RISE TIME |
|---|---|---|---|---|---|
| EMB. | 2.5 | 0.08 | 31.25 | 229° C. | 11.6 sec |
| COMP. EX. 1 | 0.21 | 0.21 | 1 | 365° C. | 13.6 sec |
| COMP. EX. 2 | 2.5 | 2.5 | 1 | 229° C. | 19.5 sec |

*1"LTC" is the longitudinal direction thermal conductivity.
*2"TTC" is the thickness device thermal conductivity.
*3"TCR" is a ratio of the longitudinal direction to the thickness device thermal conductivity.
*4"TR" is the non-sheet-passing portion temperature rise.

In the case of the fixing device in Comparison Example 1, a non-sheet-passing portion temperature rise suppressing performance largely lowered. This would be considered because the longitudinal direction thermal conductivity is small. In this case, not only when the executive-sized paper was used but also when leisure-sized paper and letter-sized paper were used, the temperature of the non-sheet-passing portion temperature rise exceeded 230° C., so that the productivity lowered.

In the case of the fixing device in Comparison Example 2, the temperature of the non-sheet-passing portion temperature rise was unchanged, but a rise time shortening performance largely lowered. This would be considered that the thickness device thermal conductivity is small.

In the fixing device A in the embodiment of the present invention, the longitudinal direction (widthwise direction) thermal conductivity was high by the needle-like filler oriented in the longitudinal direction (widthwise direction), the pressing roller 4 had a non-sheet-passing portion temperature rise suppressing effect. Not only the thickness device thermal conductivity was small but also a volumetric specific heat was small, so that also the rise time shortening performance was good.

Further, in the case where a heater including a single heat generating element, not the three heat generating elements as in the heater in the fixing device A in the embodiment of the present invention, was used, the following phenomenon occurred. Specifically, even when the pressing roller 4 in the embodiment was used, the productivity lowered in each of the cases of longitudinal feeding of the papers having A5 size, B4 size, B5 size, A4 size, letter size, and so on. Accordingly, it was confirmed that the heater including the plurality of heat generating elements is effective in improving the productivity.

As described above, the fixing device according to the present invention includes the endless belt 603 for heating, in the nip N, the recording material P carrying thereon the image T while nip-feeding the recording material P. The fixing device includes the rotatable opposing member 4, disposed opposed to the endless belt 603, for forming the nip N between itself and the endless belt 603. The rotatable opposing member 4 includes the base material 4*a* and the porous elastic layer 4*b* which is formed on the base material 4*a* and which contains the needle-like filler 4*b*1. The needle-like filler 4*b*1 is oriented in the elastic layer 4*b* so that the longitudinal direction thermal conductivity λY1 of the elastic layer 4*b* is 6 times or more and 900 times or less the thickness device thermal conductivity λ2 of the pressing roller 4*b*.

Further, the fixing device includes the heating member 600, for heating the endless belt 603 in contact with the endless belt 603, capable of changing the heat generating region into a plurality of regions. The fixing device further includes the control means 100 for controlling the heat generating region of the heating member 600 depending on the width size of the recording material P introduced into the fixing device.

By the fixing device constitution as described above, even in the case where the recording materials having various width sizes are introduced and used in the fixing device, it is possible to not only suppress the non-sheet-passing portion temperature rise but also shorten the rise time. That is, it is possible to provide an image heating apparatus having high productivity and capable of compatibly realize suppression of the non-sheet-passing portion temperature rise and shortening of the rise time.

OTHER EMBODIMENTS

1) The toner image forming principle and process on the recording material P are not limited to an electrophotographic process. An electrophotographic process of a direct type using photosensitive paper as the recording material may also be used. An electrostatic recording process of a transfer type using a dielectric member as the image bearing member or of a direct type, and a magnetic recording process of an intermediary transfer type using a magnetic material or of a direct type, and the like process may be used.

2) The fixing device may also embrace, in addition to the fixing device for fixing the unfixed toner image as the fixed image as in Embodiments, an image quality modifying device for improving glossiness or the like by re-heating and pressing the toner image temporarily fixed or once heat-fixed on the recording material.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-145832 filed on Jul. 16, 2014, which is hereby incorporated by reference herein in its entirety.

What is claimed is:

1. A fixing device comprising:

a rotatable heating member and a rotatable pressing member which are configured to fix a toner image on a recording material in a nip therebetween; and a heating mechanism configured to selectively heat regions of said rotatable heating member depending on sizes of the recording material when the sizes are predetermined ones of all sizes usable in said fixing device, wherein said rotatable pressing member includes a base layer and a porous elastic layer provided on said base layer and containing a needle-like filler, said elastic layer having a thermal conductivity, with respect to a longitudinal direction thereof, which is 6 times to 900 times a thermal conductivity with respect to a thickness direction thereof.

2. The fixing device according to claim 1, wherein a number of species of the sizes of the recording materials usable in said fixing device is more than a number of possible changes in a heating region by said heating mechanism.

3. The fixing device according to claim 1, wherein the recording material having an irregular size is capable of being subjected to a fixing process.

4. The fixing device according to claim 1, wherein said elastic layer contains the needle-like filler in an amount of 5-40 volume %.

5. The fixing device according to claim 1, wherein the needle-like filler has a thermal conductivity of 500 W/(m·K) or more.

6. The fixing device according to claim 5, wherein the needle-like filler contains carbon fibers.

7. The fixing device according to claim 5, wherein the needle-like filler is 5-11 μm in length with respect to a widthwise direction and is 50-1000 μm in length with respect to the longitudinal direction.

8. The fixing device according to claim 1, wherein a porosity of said elastic layer is 20-70 volume %.

9. The fixing device according to claim 1, further comprising a fluorine-containing resin layer provided on said elastic layer.

10. The fixing device according to claim 1, wherein said rotatable pressing member is contactable to an opposite surface of the recording material from a toner image-formed surface of the recording material.

* * * * *